US011255169B2

(12) United States Patent
Tajallipour et al.

(10) Patent No.: US 11,255,169 B2
(45) Date of Patent: Feb. 22, 2022

(54) SYSTEM AND METHOD FOR WIRELESS CONTROL OF WELL BORE EQUIPMENT

(71) Applicant: NCS Multistage Inc., Calgary (CA)

(72) Inventors: Ramin Tajallipour, Calgary (CA); Lyle Laun, Calgary (CA); Michael Werries, Calgary (CA); Roman Vakulin, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 198 days.

(21) Appl. No.: 16/485,485

(22) PCT Filed: Feb. 13, 2018

(86) PCT No.: PCT/CA2018/050160
§ 371 (c)(1),
(2) Date: Oct. 8, 2019

(87) PCT Pub. No.: WO2018/145215
PCT Pub. Date: Aug. 16, 2018

(65) Prior Publication Data

US 2021/0115767 A1 Apr. 22, 2021

Related U.S. Application Data

(60) Provisional application No. 62/458,194, filed on Feb. 13, 2017.

(51) Int. Cl.
*E21B 43/12* (2006.01)
*E21B 47/18* (2012.01)
(Continued)

(52) U.S. Cl.
CPC ..... *E21B 43/12* (2013.01); *E21B 47/18* (2013.01); *E21B 34/08* (2013.01); *E21B 34/10* (2013.01); *E21B 47/06* (2013.01); *E21B 2200/06* (2020.05)

(58) Field of Classification Search
CPC ..... E21B 43/12; E21B 47/18; E21B 2200/06; E21B 34/08; E21B 34/10; E21B 47/06; E21B 43/14
See application file for complete search history.

(56) References Cited

U.S. PATENT DOCUMENTS 6,173,772 B1 * 1/2001 Vaynshteyn ..... E21B 23/04 166/250.15
6,182,764 B1 * 2/2001 Vaynshteyn ..... E21B 34/16 166/373
(Continued)

FOREIGN PATENT DOCUMENTS

WO 2014025701 A1 2/2014

OTHER PUBLICATIONS

International Search Report re: International Patent Application No. PCT/CA2018/050160 dated May 23, 2018.

*Primary Examiner* — Michael R Wills, III
(74) *Attorney, Agent, or Firm* — Ridout & Maybee LLP

(57) ABSTRACT

There is provided an apparatus for controlling flow in a well bore, comprising: a housing defining a fluid passage; a flow control device sealing an outlet of said fluid passage; an actuator for manipulating said flow controller control device to an open condition to permit fluid flow through said outlet; a controller for selectively activating said actuator; an acoustic receiver in communication with said controller, said acoustic receiver configured to receive acoustic signals comprising programming instructions for said controller.

20 Claims, 19 Drawing Sheets

(51) Int. Cl.

| | |
|---|---|
| *E21B 34/08* | (2006.01) |
| *E21B 34/10* | (2006.01) |
| *E21B 47/06* | (2012.01) |

(56) References Cited

U.S. PATENT DOCUMENTS

| | | | | |
|---|---|---|---|---|
| 6,320,820 | B1 * | 11/2001 | Gardner | E21B 47/16 367/81 |
| 2003/0016116 | A1 | 1/2003 | Finke et al. | |
| 2010/0073190 | A1 * | 3/2010 | Fanini | E21B 47/12 340/855.7 |
| 2015/0025806 | A1 | 1/2015 | Pillai et al. | |
| 2015/0240630 | A1 | 8/2015 | Chambers | |
| 2016/0265310 | A1 * | 9/2016 | Getzlaf | E21B 34/103 |
| 2016/0312579 | A1 * | 10/2016 | Green | E21B 47/14 |
| 2016/0333679 | A1 * | 11/2016 | Getzlaf | E21B 34/10 |
| 2017/0306755 | A1 * | 10/2017 | Barak | E21B 34/06 |

* cited by examiner

SYSTEM AND METHOD FOR WIRELESS CONTROL OF WELL BORE EQUIPMENT

RELATED APPLICATIONS

This application claims the benefit of and priority to U.S. Provisional Patent Application No. 62/458,194, filed Feb. 13, 2017, the contents of which are incorporated herein by reference.

FIELD

The present disclosure relates to hydraulic fracturing and, in particular, to control of downhole components in hydraulic fracturing.

BACKGROUND

The number of stages accessible for hydraulic fracturing is generally limited due to mechanical limitations of existing technologies. Challenges exist with providing reliable isolation of previously fractured stages. Multistage fracturing of, and subsequent production from, horizontal wells requires the ability to control flow communication between the wellbore and the reservoir at multiple locations along the wellbore. Valving systems are incorporated within well completions to enable such control flow communication. Controllable actuation of such valving systems is a challenge, by virtue of the difficulty in physically accessing such valving system within deep horizontal wells.

Mechanical shifting tools, deployable within wellbores using workstrings, have been developed to enable such actuation. However, significant costs are associated with their repeated deployment in order to perform multiple open-close operations.

Remote signalling is also being developed as an alternative means for actuating downhole valving systems. In order to be useful, however, signals must be reliably transmitted downhole and addressable to the valve intended to be controlled.

SUMMARY

In one aspect, there is provided an apparatus for controlling flow in a well bore, comprising: a housing defining a fluid passage; a flow control device sealing an outlet of said fluid passage; an actuator for manipulating said flow control device to an open condition to permit fluid flow through said outlet; a controller for selectively activating said actuator; an acoustic receiver in communication with said controller, said acoustic receiver configured to receive acoustic signals comprising programming instructions for said controller.

In another aspect, there is provided a method of operating a flow control device in a wellbore string, comprising: encoding a control message for opening said flow control device as a sequence of digits; transmitting said control message by relieving pressure from a fluid in said wellbore string in a sequence of stages, wherein said relieving pressure comprises modulating a rate of change of fluid pressure to one of a plurality of threshold values in each stage, each said threshold value corresponding to a possible one of said digits.

In another aspect, there is provided a method of operating a flow control device in a wellbore string, comprising: at said flow control device, periodically measuring a rate of pressure change and a rate of temperature change of fluid in said wellbore string; incrementing a counter if said rate of pressure change and said rate of temperature change are within respective value ranges; closing said flow control device in response to said counter reaching a threshold value.

According to one example aspect is a method of remotely operating a flow control device in a wellbore string. The method includes encoding a control message as a sequence of digits for actuating said flow control device and transmitting said control message by relieving pressure from a fluid in said wellbore string in a sequence of stages, wherein said relieving pressure comprises modulating a rate of change of fluid pressure over the sequence of stages to encode the sequence of digits.

According to another example aspect a control system is disclosed for remotely operating a flow control device in a wellbore string. The control system includes: an actuator for opening and closing a valve to selectively release pressure from a fluid in the wellbore string; and a wellhead controller configured to cause the actuator to open and close the valve to modulate a control message onto the fluid for the flow control device by selectively releasing pressure from the fluid in stages, wherein each stage corresponds to a digit of the control message.

According to a further example aspect is a method of operating a flow control apparatus in a wellbore string, the flow control apparatus comprising a housing defining a fluid passage, a flow control device sealing an outlet of said fluid passage, an actuator for manipulating said flow control device to an open condition to permit fluid flow through said outlet, a controller for selectively activating said actuator, and a pressure sensor for sensing pressure in the fluid passage. The method includes: periodically sampling a pressure in the fluid passage using the pressure sensor; analyzing the samples, by the controller, to determine if a control message has been pressure modulated onto a fluid in the fluid passage, and if so, decoding the control message based on the samples and determining if the decoded control message includes an instruction for the controller to activate said actuator; and activating the actuator, if the control message includes an instruction for the controller to activate said actuator, to manipulate said flow control device to the open condition.

According to a further example embodiment, a flow control apparatus for use in a wellbore string is disclosed, including: a housing defining a fluid passage; a flow control device sealing an outlet of said fluid passage; an actuator for manipulating said flow control device to an open condition to permit fluid flow through said outlet; and a pressure sensor for sensing pressure in the fluid passage. The apparatus includes a controller configured to: receive periodic pressure samples for fluid in the fluid passage from the pressure sensor; analyze the pressure samples to determine if a control message has been pressure modulated onto a fluid in the fluid passage, and if so, decode the control message based on the pressure samples and determine if the decoded control message includes an instruction for the controller to activate said actuator; and activate the actuator, if the control message includes an instruction for the controller to activate said actuator, to manipulate said flow control device to the open condition.

According to a further example embodiment is an apparatus for controlling flow in a well bore. The apparatus includes a housing defining a fluid passage; a flow control device sealing an outlet of said fluid passage; an actuator for manipulating said flow control device to an open condition to permit fluid flow through said outlet; a controller for selectively activating said actuator; and an acoustic receiver in communication with said controller, said acoustic receiver configured to receive acoustic signals comprising programming instructions for said controller.

According to a further example aspect is a method of programming a flow control apparatus. The flow control apparatus includes: a housing defining a fluid passage; a flow control device sealing an outlet of said fluid passage; an actuator for manipulating said flow control device to an open condition to permit fluid flow through said outlet; a controller for selectively activating said actuator; an acoustic receiver in communication with said controller, said acoustic receiver configured to receive acoustic signals comprising programming instructions for said controller The method includes pre-programming the controller prior to installing the flow control apparatus in a downhole well-bore string by receiving acoustic signals through the acoustic receiver and decoding the acoustic signals to recover the programming instructions for said controller.

According to another example aspect is an apparatus for controlling flow in a well bore, including: a housing defining an internal fluid passage; a flow control device sealing an outlet of said fluid passage; an actuator for manipulating said flow control device to an open condition to permit fluid flow through said outlet; a controller for selectively activating said actuator; and an optical sensor configured to receive optical signals from a location external to said housing, the optical signals comprising programming instructions for said controller.

According to a further example embodiment is a method of programming a flow control apparatus comprising: pre-programming a controller of the flow control apparatus prior to installing the flow control apparatus in a downhole well-bore string by receiving optical signals through an optical sensor and decoding the optical signals to recover the programming instructions for said controller.

According to another example aspect is method of operating a flow control device in a wellbore string, comprising: at said flow control device, periodically measuring a rate of pressure change and a rate of temperature change of fluid in said wellbore string; incrementing a counter if said rate of pressure change and said rate of temperature change are within respective value ranges; and closing said flow control device in response to said counter reaching a threshold value.

According to another example aspect is a flow control apparatus comprising: a housing including a housing passage; a flow communicator extending through the housing; a flow control member displaceable relative to the flow communicator for controlling flow communication, via the flow communicator, between the housing passage and an environment external to the housing; a sensor configured for sensing an actuating condition, wherein the actuating condition includes a characteristic within the wellbore that is produced in response to a movement of the flow control member relative to the flow communicator; a timer configured to start a countdown timer in response to the sensing of the actuating condition by the sensor. The sensor, the timer, and the flow control member are co-operatively configured such that, in response to the sensing of an actuating condition, the timer starts a countdown timer, and, in response to the expiry of the countdown timer, displacement of the flow control member, relative to the flow communicator, is effected.

According to a further example aspect is a process for producing hydrocarbon material from a reservoir via a wellbore, comprising: (a) effecting stimulation of the reservoir, including: within the wellbore, displacing a flow control member, relative to a flow communicator, such that opening of the flow communicator is effected; while the flow communication is established between the wellbore and the reservoir via the flow communicator, injecting treatment material into the reservoir via the flow communicator for effecting stimulation of the reservoir; and after the injecting of treatment material, within the wellbore, displacing the flow control member, relative to the flow communicator, with effect that closing of the flow communicator is effected, such that the stimulation is completed; and (b) effecting production of hydrocarbon material from the reservoir, including: after the completion of the stimulation, starting a countdown timer; and in response to the expiry of the countdown timer, within the wellbore, displacing the flow control member, relative to the flow communicator, such that opening of the flow communicator is effected.

According to a further example embodiment is a process for controlling fluid flow between a wellbore and a subterranean formation via a flow communicator using a flow control member that is disposed within the wellbore, comprising: moving the flow control member relative to the flow communicator; sensing the movement of the flow control member relative to the flow communicator; in response to the sensed movement, starting a countdown timer; and in response to the expiry of the countdown timer, displacing the flow control member relative to the flow communicator.

BRIEF DESCRIPTION OF DRAWINGS

The preferred embodiments will now be described with the following accompanying drawings, in which.

DETAILED DESCRIPTION

Figure 1:
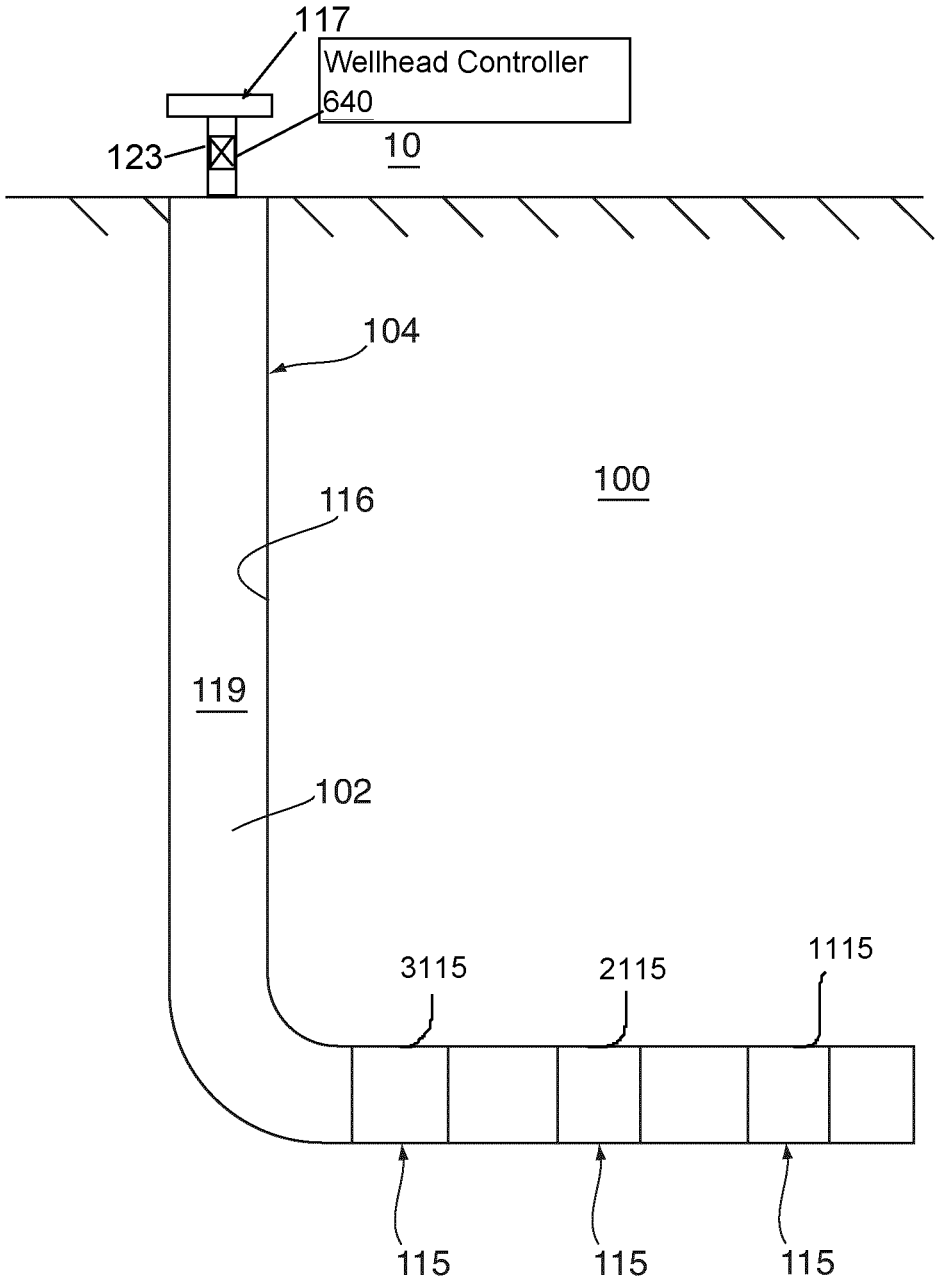
FIG. 1 is a schematic illustration of a system for effecting fluid communication between the surface and a subterranean formation via a wellbore.

Referring to FIG. 1, there is provided a wellbore material transfer system 104 for conducting material from the surface 10 to a subterranean formation 100 via a wellbore 102, from the subterranean formation 100 to the surface 10 via the wellbore 102, or between the surface 10 and the subterranean formation 100 via the wellbore 102. In some embodiments, for example, the subterranean formation 100 is a hydrocarbon material-containing reservoir.

In some embodiments, for example, the conducting (such as, for example, by flowing) material to the subterranean formation 100 via the wellbore 102 is for effecting selective stimulation of a hydrocarbon material-containing reservoir. The stimulation is effected by supplying treatment material to the hydrocarbon material-containing reservoir. In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir. In some embodiments, for example, the treatment material includes water, and is supplied to effect waterflooding of the reservoir. In some examples the treatment material may include a gas.

In some embodiments, for example, the conducting (such as, for example, by flowing) material from the subterranean formation 100 to the surface 10 via the wellbore 102 is for effecting production of hydrocarbon material from the hydrocarbon material-containing reservoir. In some of these embodiments, for example, the hydrocarbon material-containing reservoir, whose hydrocarbon material is being produced by the conducting via the wellbore 102, has been, prior to the producing, stimulated by the supplying of treatment material to the hydrocarbon material-containing reservoir.

In some embodiments, for example, the conducting to the subterranean formation 100 from the surface 10 via the wellbore 102, or from the subterranean formation 100 to the surface 10 via the wellbore 102, is effected via one or more flow communication stations 115 that are disposed at the interface between the subterranean formation 100 and the wellbore 102. In some embodiments, for example, the flow communication stations 115 are integrated within a wellbore string 116 that is deployed within the wellbore 102. Integration may be effected, for example, by way of threading or welding.

A wellhead 117 may be provided at the surface for communication of fluid into or out of wellbore 102 and wellbore string 116. Wellhead 117 may be connected to a production conduit for receiving fluid produced via the wellbore 102. Wellhead 117 may further be connected to an injection conduit for communicating fluid into wellbore 102 and wellbore string 116. Wellhead 117 may have one or more valves 123, operable to selectively permit or restrict flow from wellbore string 116 to production conduit and from injection conduit to wellbore string 116. The one or more valves 123 may be operable to open in discrete or continuously variable stages, such that the flow rate from wellbore string 116 to production conduit 121*a* and from injection conduit to wellbore string 116 is adjustable. In an example, at least some of valves 123 are proportional valves. The one or more valves 123 may further be operable to selectively vent wellbore string 116 to atmosphere.

The wellbore string 116 includes one or more of pipe, casing, and liner, and may also include various forms of tubular segments, such as the flow control apparatuses 115A described herein. The wellbore string 116 defines a wellbore string passage 119 for effecting conduction of fluids between the surface 10 and the subterranean formation 100. In some embodiments, for example, the flow communication station 115 is integratable within the wellbore string 116 by a threaded connection.

Successive flow communication stations 115 may be spaced from each other along the wellbore string 116 such that each flow communication stations 115 is positioned adjacent a zone or interval of the subterranean formation 100 for effecting flow communication between the wellbore 102 and the zone (or interval).

For effecting the flow communication, the flow communication station 115 includes a flow control apparatus 115A. Referring to FIGS. 2 to 6, the flow control apparatus 115A includes one or more ports 118 through which the conducting of the material is effected. The ports 118 are disposed within a sub that has been integrated within the wellbore string 116, and are pre-existing, in that the ports 118 exist before the sub, along with the wellbore string 116, has been installed downhole within the wellbore string 116.

The flow control apparatus 115A includes a flow control member 114 for controlling the conducting of material by the flow control apparatus 115A via the one or more ports 118. The flow control member 114 is displaceable, relative to the one or more ports 118, for effecting opening of the one or more ports 118. In some embodiments, for example, the flow control member 114 is also displaceable, relative to the one or more ports 118, for effecting closing of the one or more ports 118. In this respect, the flow control member 114 is displaceable from a closed position (see FIG. 2) to an open position (see FIG. 3). The open position of the flow control member 114 corresponds to an open condition of the one or more ports 118. The closed position of the flow control member 114 corresponds to a closed condition of the one or more ports 118.

In some embodiments, for example, the flow control member 114 is displaceable mechanically, such as, for example, with a shifting tool. In some embodiments, for example, the flow control member 114 is displaceable hydraulically, such as, for example, by communicating pressurized fluid via the wellbore to urge the displacement of the flow control member 14. In some embodiments, for example, the flow control member 114 is integrated within a flow control apparatus which includes an actuator for effecting displacement of the flow control member 114 hydraulically in response to receiving of a signal transmitted from the surface 10.

In some embodiments, for example, in the closed position (see FIG. 2), the one or more ports 118 are covered by the flow control member 114, and the displacement of the flow control member 114 to the open position (see FIG. 3) effects at least a partial uncovering of the one or more ports 118 such that the one or more ports 118 become disposed in the open condition. In some embodiments, for example, in the closed position, the flow control member 114 is disposed, relative to the one or more ports 118, such that a sealed interface is disposed between the wellbore string 116 and the subterranean formation 100, and the disposition of the sealed interface is such that the conduction of material between the wellbore string 116 and the subterranean formation 100, via the flow communication station 115 is prevented, or substantially prevented, and displacement of the flow control member 114 to the open position effects flow communication, via the one or more ports 118, between the wellbore string 116 and the subterranean formation 100, such that the conducting of material between the wellbore string 116 and the subterranean formation 100, via the flow communication station, is enabled. In some embodiments, for example, the sealed interface is established by sealing engagement between the flow control member 114 and the wellbore string 116. In some embodiments, for example, the flow control member 114 includes a sleeve. The sleeve is slideably disposed within the wellbore string passage 119.

In some embodiments, for example, the flow control apparatus 115A includes a housing 120. The housing 120 includes one or more sealing surfaces configured for sealing engagement with a flow control member 114, wherein the sealing engagement defines the sealed interface described above. In this respect, sealing surfaces 124, 126 are defined on an internal surface of the housing 120 for sealing engagement with the flow control member 114. In some embodiments, for example, each one of the sealing surfaces 124, 126 is defined by a respective sealing member. In some embodiments, for example, each one of the sealing members, independently, includes an o-ring. In some embodiments, for example, the o-ring is housed within a recess formed within the housing 120. In some embodiments, for example, the sealing member includes a molded sealing member (i.e. a sealing member that is fitted within, and/or bonded to, a groove formed within the sub that receives the sealing member). In some embodiments, for example, the one or more ports 118 extend through the housing 120, and are disposed between the sealing surfaces 124, 126.

The housing 120 includes a housing passage 125 which forms a portion of the wellbore string passage 119 for effecting material transfer between the surface 10 and the subterranean formation 100. In this respect, material transfer between the housing passage 125 and the subterranean formation 100 is effected via the one or more ports 118. The housing 120 includes an inlet 120A and an outlet 120B. The inlet 120A fluidly communicates with the outlet 120B via the housing passage 125.

The flow control member 114 co-operates with the sealing members 122, 124 to effect opening and closing of the one or more ports 118. When the one or more ports 118 is disposed in the closed condition, the flow control member 114 is sealingly engaged to both of the sealing members 122, 124, thereby preventing, or substantially preventing, treatment material, being supplied through the wellbore string passage 119 (including the housing passage 125) from being injected into the subterranean formation 100 via the one or more ports 118. When the one or more ports 118 is disposed in the open condition, the flow control member 114 is spaced apart or retracted from at least one of the sealing members thereby providing a passage for treatment material, being supplied through the wellbore string passage 119, to be injected into the subterranean formation 100 via the one or more ports 118.

Each one of the opening force and the closing force may be, independently, applied to the flow control member 114 mechanically, hydraulically, or a combination thereof. In some embodiments, for example, the flow control member 114 is integrated within a flow control apparatus 115A which includes an actuator for effecting displacement of the flow control member 114 hydraulically in response to sensing of a signal transmitted from the surface 10 by a sensor 150 (see below).

In some embodiments, for example, while the flow control apparatus 115A is being deployed downhole with the wellbore string 116, the flow control member 114 is disposed in the closed position by one or more shear pins, and is thereby restricted from displacement relative to the one or more ports 118 such that opening of the one or more ports 118 is effected. The one or more shear pins are provided to secure the flow control member 114 to the wellbore string 116 (including while the wellbore string is being installed downhole) so that the passage 119 is maintained fluidically isolated from the formation 100 until it is desired to treat the formation 100 with treatment material. To effect the initial displacement of the flow control member 114 from the closed position to the open position, sufficient force must first be applied to the one or more shear pins such that the one or more shear pins become sheared, resulting in the flow control member 114 becoming moveable relative to the one or more ports 118. In some operational implementations, the force that effects the shearing is applied by a workstring. Alternatively, in some embodiments, for example, the flow control member 114 is restricted from displacement relative to the one or more ports 118 (such that opening of the one or more ports 118 is effected), while being deployed downhole with the workstring, by being disposed in press fit engagement with the housing 120.

In some embodiments, for example, the flow control member 114 includes a sliding sleeve.

Figure 5:
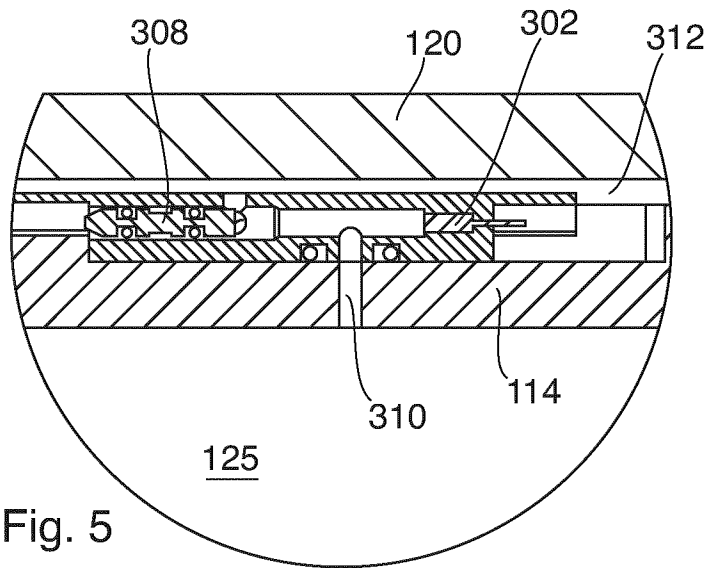
FIG. 5 is a sectional view of the portion illustrated in FIG. 4, with the actuatable valve having become displaced and thereby effecting fluid communication between the fluid responsive surface and the housing passage.
Figure 4:
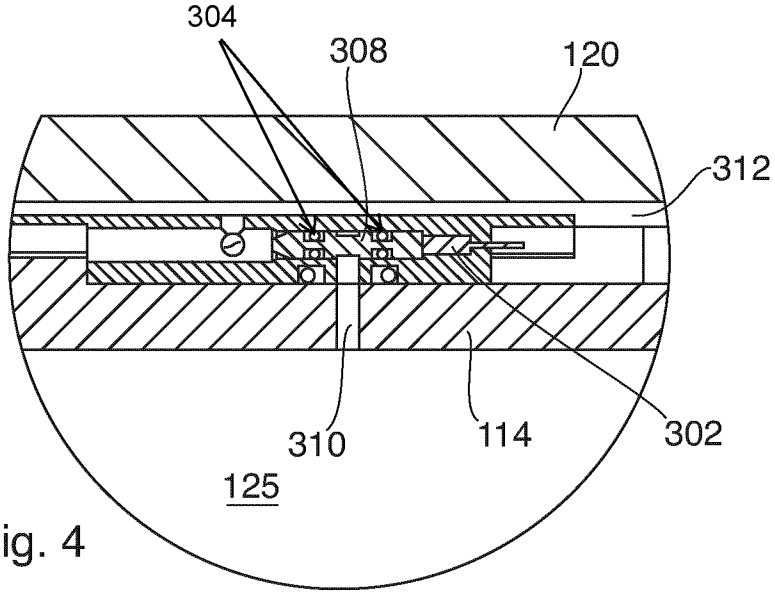
FIG. 4 is a sectional view of a portion of an embodiment of the flow control apparatus illustrated in FIG. 2, showing one configuration for effecting displacement of the flow control member by establishing fluid communication between a fluid responsive surface of the flow control member and the housing passage, with an actuatable valve effecting sealing, or substantial sealing of the fluid communication, and with the flow control member disposed in the closed position.
Figure 6:
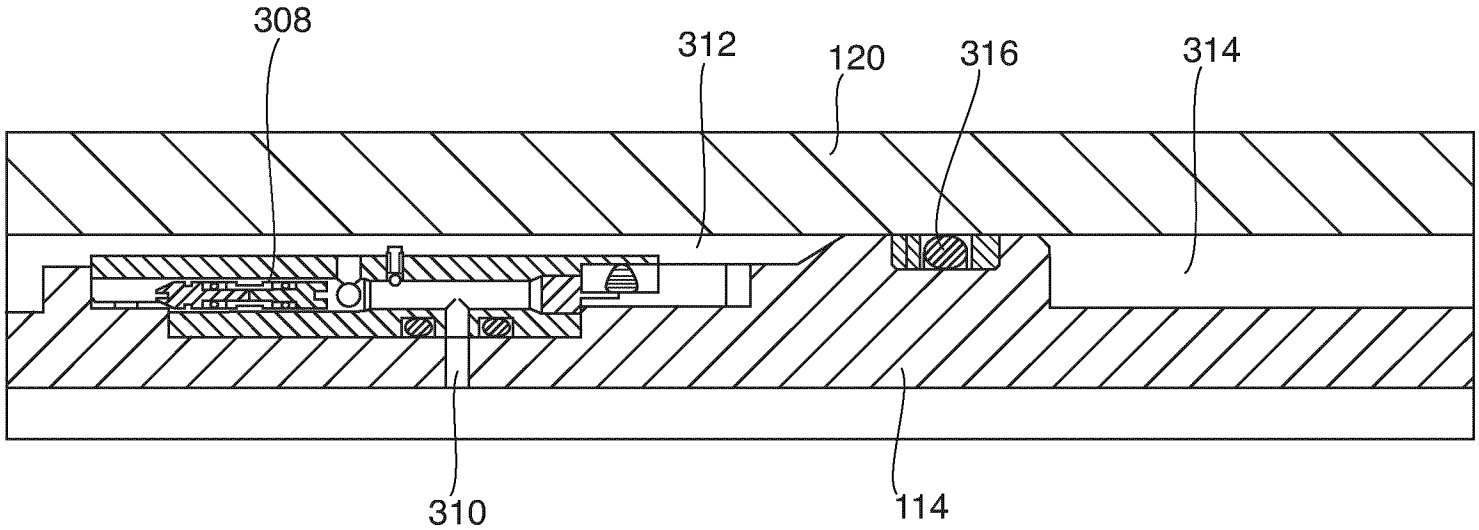
FIG. 6 is a sectional view of a larger portion of the embodiment of the flow control apparatus illustrated in FIG. 3, with the flow control member having been displaced to the open position, in response to the urging of fluid pressure acting on the fluid responsive surface.
Figure 7:
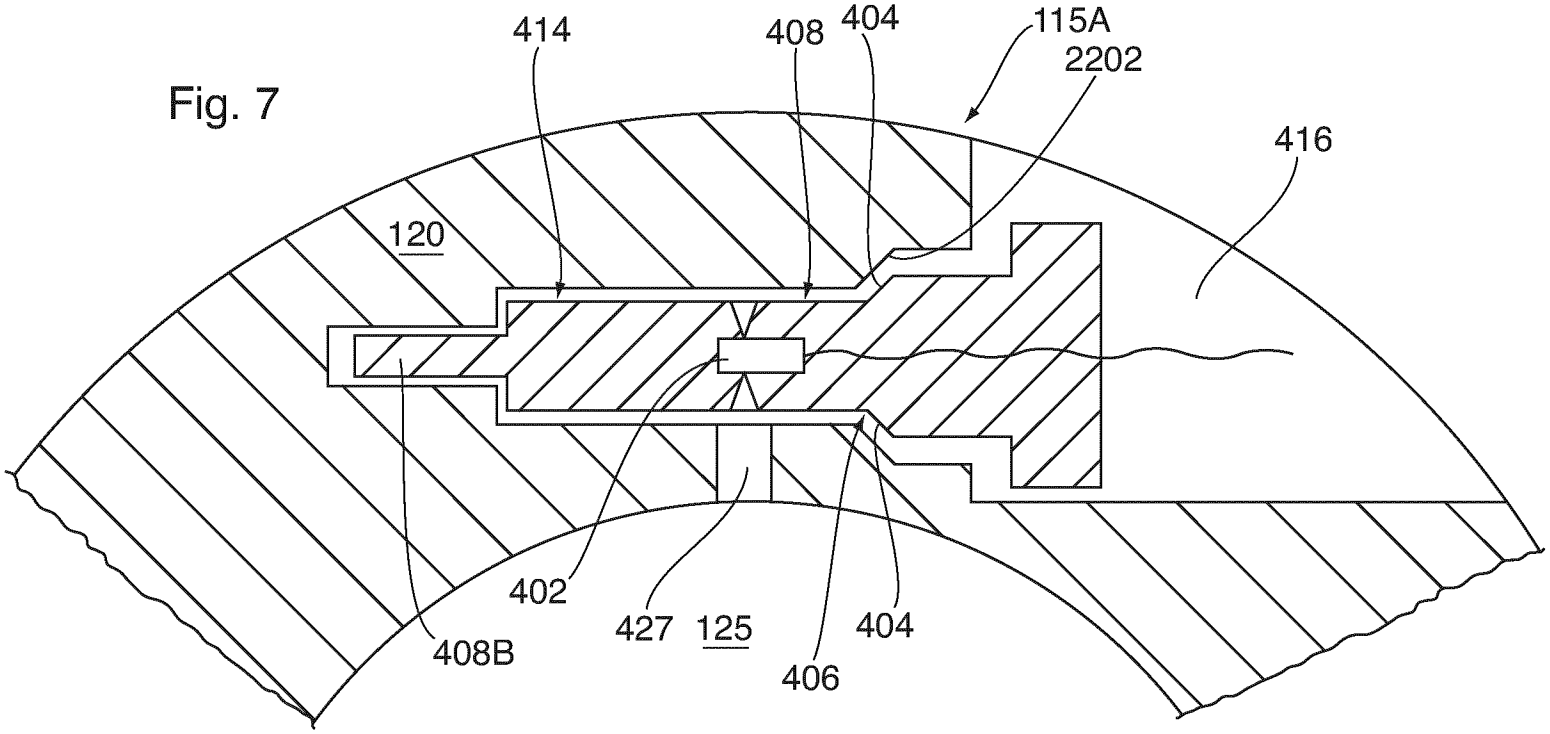
FIG. 7 is a sectional view of a portion of another embodiment of the flow control apparatus illustrated in FIG. 2, showing one configuration for effecting displacement of the flow control member by establishing fluid communication between a fluid responsive surface of the flow control member and the housing passage, with an exploding bolt effecting sealing, or substantial sealing of the fluid communication.
Figure 8:
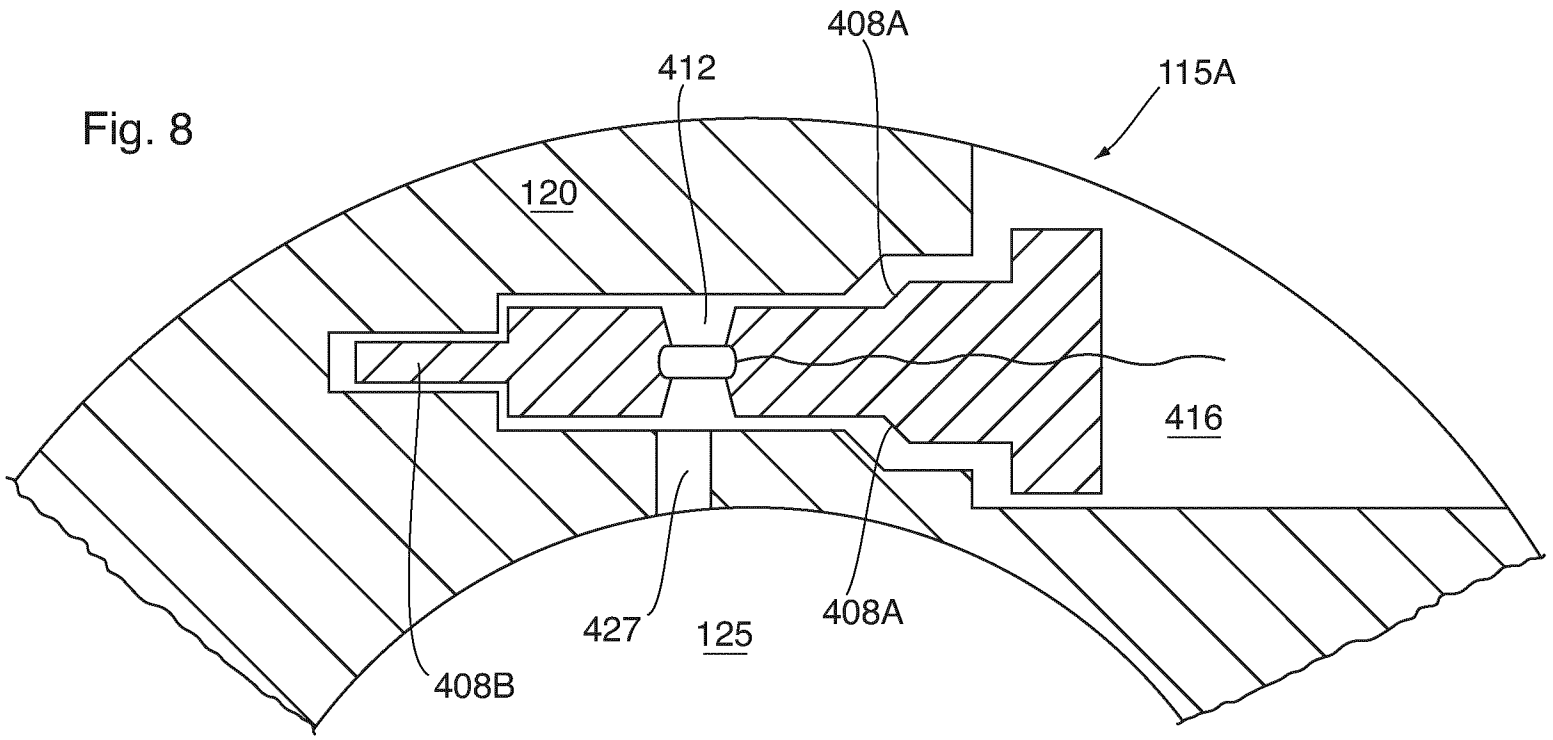
FIG. 8 is a sectional view of the portion the flow control apparatus illustrated in FIG. 7, illustrated after fracturing of the bolt.

Referring to FIGS. 4 to 6, in some embodiments, for example, the displacement of the flow control member 114 from the closed position to the open position is effectible in response to urging by fluid pressure that is communicated from the housing passage 125 to a fluid responsive surface 140. The fluid communication between the housing passage 125 and the fluid responsive surface 140 is establishable, directly or indirectly, in response to sensing, by the sensor 150, of a signal that is communicated downhole. The fluid communication may be selectively permitted by an opening actuation system, a first example embodiment of which is shown in depicted in FIGS. 4 to 6, and a second example embodiment of which is shown in FIGS. 7 and 8. to.

Figure 3:
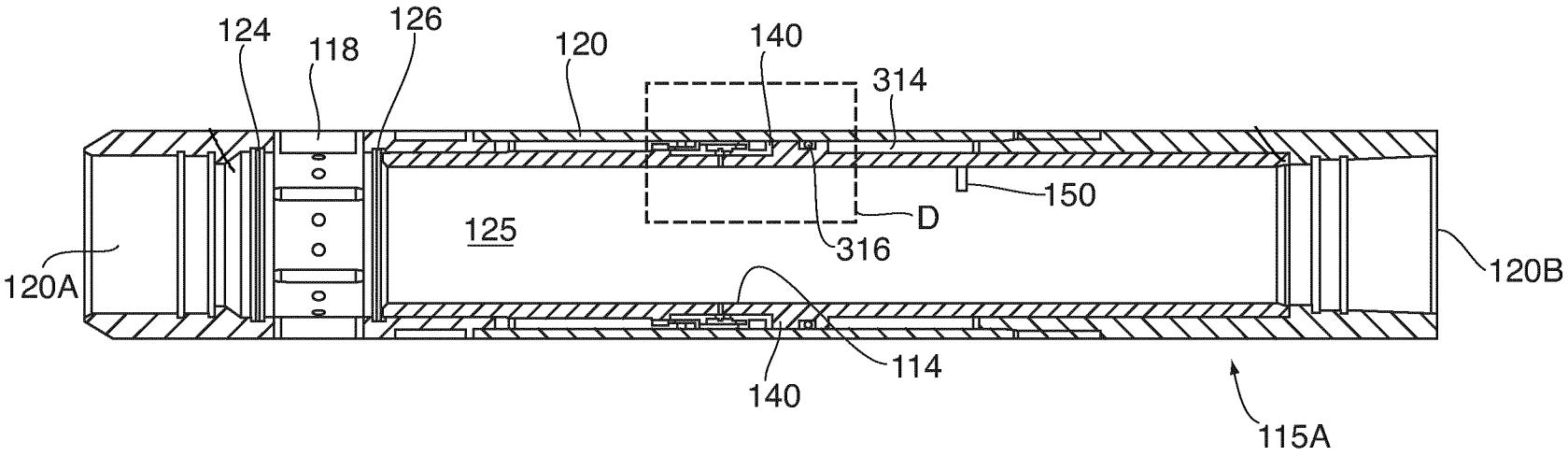
FIG. 3 is a side sectional view of the flow control apparatus illustrated in FIG. 2, illustrating the ports in the opened condition.

In this respect, in some embodiments, for example, and referring to FIG. 3 and the first embodiment of FIGS. 4 to 6, the flow control apparatus 115A includes a fluid communication actuator 302 and a sealing interface 304. The sealing interface 304 effects sealing, or substantial sealing, of the fluid responsive surface 140 from the housing passage 125. The fluid communication actuator 302 is configured for defeating the sealing interface 304. In this respect, the actuator 302 is responsive to sensing a control signal that is addressed to the flow control apparatus 115A. In one example, the control signal is a sealing interface-defeating ("SID") signal, sensed by the sensor 150 of flow control apparatus 115A, for defeating the sealing interface 304 such that establishment of fluid communication between the housing passage 125 and the fluid responsive surface 140 is effected.

In some embodiments, for example, the SID signal is transmitted through the wellbore 102. In some of these embodiments, for example, the SID signal is transmitted via fluid disposed within the wellbore 102.

In some examples, sensor 150 is enabled to take measurements that will allow controller 500 to determine a rate of flow change in a pressurised fluid in the wellbore string passage. For example, in some embodiments, the sensor 150 is a pressure sensor, and the actuating signal is one or more pressure pulses. Various suitable sensors may be employed, depending on the nature of the signal being used for the actuating signal. An exemplary pressure sensor is a Kellar Pressure Transducer. Additional or other suitable sensors include a Hall effect sensor, a radio frequency identification ("RFID") sensor, or a sensor that can detect a change in chemistry (such as, for example, pH), or radiation levels, or ultrasonic waves.

As described in further detail below, in some embodiments, the SID signal is sent by introducing modulated pressure changes within wellbore passage 119. Specifically, pressure changes may be created within wellbore 119 in a sequence of stages, with each stage having a particular rate of pressure change. The rate of pressure change corresponds to a digit or symbol in a number system, e.g. a binary or quaternary number system. In some embodiments, for example, the sensor 150 is disposed in communication within the wellbore 102, and the SID signal is being transmitted within the wellbore 102, such that the sensor 150 is disposed for sensing the SID signal being transmitted within the wellbore 102. In some embodiments, for example, the sensor 150 is disposed within the wellbore 102. In this respect, in some embodiments, for example, the sensor 150 is mounted to the housing 120 within a hole that extends to the wellbore 102, and is held in by a backing plate that is configured to resist the force generated by pressure acting on the sensor 150.

In some alternative embodiments, for example, the sensor 150 is configured to receive a signal generated by a seismic source. In some embodiments, for example, the seismic source includes a seismic vibrator unit. In some of these embodiments, for example, the seismic vibration unit is disposed at the surface 10.

In some embodiments, for example, the flow control apparatus 115 further includes a valve member 308, and the sealing interface 304 is defined by a sealing, or substantially sealing, engagement between the valve member 308 and the housing 120. In some embodiments, for example, the sealing interface 304 is defined by sealing members (such as, for example, o-rings) carried by the valve member 308. In this respect, the change in condition of the sealing interface 304 is effected by a change in condition of the valve member 308. Also in this respect, the actuator 302 is configured to effect a change in condition of the valve member 308 (in response to the sensing of the SID signal by the sensor 150) such that there is a loss of the sealing, or substantially sealing, engagement between the valve member 308 and the housing 120, such that the sealing interface 304 is defeated, and such that fluid communication between the housing passage 125 and the fluid responsive surface 140 is established.

In some embodiments, for example, the valve member 308 is displaceable, and the change in condition of the valve member 308, which the actuator 302 is configured to effect in response to the sensing of a SID signal by the sensor 150, includes displacement of the valve member 308. In this respect, the actuator 302 is configured to effect displacement of the valve member 308 such that the sealing interface 304 is defeated and such that fluid communication between the housing passage 125 and the fluid responsive surface 140 is established.

In some embodiments, for example, the flow control apparatus 115A further includes a passageway 310. The valve member 308 and the passageway 310 are co-operatively disposed such that fluid communication between the housing passage 125 and the fluid responsive surface 140 is established in response to the displacement of the valve member 308, which is effected in response to the sensing of the SID signal by the sensor 150. In this respect, the establishing of the fluid communication between the housing passage 125 and the fluid responsive surface 140 is controlled by the positioning of the valve member 308 within the passageway 310. In this respect, the valve member 308 is configured for displacement relative to the passageway 310. In some embodiments, for example, the valve member 308 includes a piston. The displacement of the valve member 308 is from a closed position (see FIG. 4) to an open position (see FIG. 5). In some embodiments, for example, when disposed in the closed position, the valve member 308 is occluding the passageway 310. In some embodiments, for example, when the valve member 308 is disposed in the closed position, sealing, or substantial sealing, of fluid communication, between the housing passage 125 and the fluid responsive surface 140 is effected. When the valve member 308 is disposed in the open position, fluid communication is effected between the housing passage 125 and the fluid responsive surface 140.

In some embodiments, for example, the passageway 310 extends through the flow control member 114, and the valve member 308 is disposed in a space within the flow control member 114, such that the displacement of the valve member 308 is also relative to the flow control member 114.

In some embodiments, for example, the actuator 302 includes an electro-mechanical trigger, such as an energetic device. The energetic device is configured to, in response to the signal received by the sensor 150, effect generation of an explosion. In some embodiments, for example, the energetic device is mounted within the body such that the generated explosion effects the displacement of the valve member 308. An example of an energetic device is a squib. Another suitable actuator 302 is a fuse-able link or a piston pusher.

In some embodiments, for example, the flow control apparatus 115A further includes first and second chambers 312, 314. The first chamber 312 is disposed in fluid communication with the fluid responsive surface 140 for receiving pressurized fluid from the housing passage 125, and the second chamber 314 is configured for containing a fluid and disposed relative to the flow control member 114 such that fluid contained within the second chamber 314 opposes the displacement of the flow control apparatus 115A that is being urged by pressurized fluid within the first chamber 312, and the displacement of the flow control member 114 is effected when the force imparted to the flow control member 114 by the pressurized fluid within the first chamber 312 exceeds the force imparted to the flow control member by the fluid within the second chamber 314. In some embodiments, for example, the displacement of the flow control member 114 is effected when the pressure imparted to the flow control member 114 by the pressurized fluid within the first chamber 312 exceeds the pressure imparted to the flow control member 114 by the fluid within the second chamber 314.

In some embodiments, for example, both of the first and second chambers 312, 314 are defined by respective spaces interposed between the housing 120 and the flow control member 114, and a chamber sealing member 316 is also included for effecting a sealing interface between the chambers 312, 314, while the flow control member 114 is being displaced to effect the opening of the one or more ports 118.

In some embodiments, for example, to mitigate versus inadvertent opening, the valve member 308 may, initially, be detachably secured to the housing 120, in the closed position. In this respect, in some embodiments, for example, the detachable securing is effected by a shear pin configured for becoming sheared, in response to application of sufficient shearing force, such that the valve member 308 becomes movable from the closed position to the open position. In some embodiments, for example, the shearing force is effected by the actuator 302.

In some embodiments, for example, to prevent the inadvertent opening of the valve member 308, the valve member 308 may be biased to the closed position, such as by, for example, a resilient member such as a spring. In this respect, the actuator 302 used for effecting opening of the valve member 308 must exert sufficient force to at least overcome the biasing force being applied to the valve member 308 that is maintaining the valve member 308 in the closed position.

In some embodiments, for example, to prevent the inadvertent opening of the valve member 308, the valve member 308 may be pressure balanced such that the valve member 308 is disposed in the closed position.

In some embodiments, for example, the flow control apparatus 115A further includes a control assembly, as described in greater detail below. The control assembly includes a controller that is configured to decode (recognize) a sensor-transmitted signal from the sensor 150 when the sensor 150 senses the SID signal and, in response to the received sensor-transmitted signal from the sensor 150, the controller will transmit an actuation command to the actuator 302. The controller may poll the sensor 150 to receive the sensor-transmitted signal or the sensor 150 may be configured to push the sensor-transmitted signal to the controller without being polled. In some embodiments, for example, the controller and the sensor 150 are powered by a battery that is disposed on-board within the flow control apparatus 115A. Passages for wiring for electrically interconnecting the battery, the sensor, the controller and the trigger are also provided within the apparatus 115A.

Figure 2:
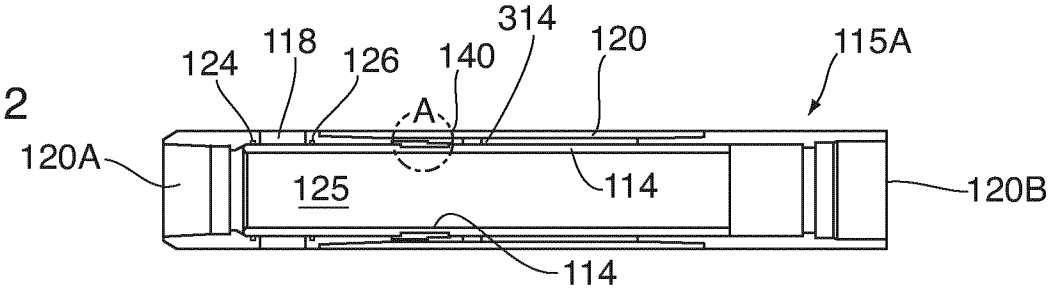
FIG. 2 is a side sectional view of an embodiment of a flow control apparatus for use in the system illustrated in FIG. 1, illustrating the ports in the closed condition.

As noted above, FIGS. 7 and 8 illustrate an alternative embodiment of an opening actuation system that can be used in the flow control apparatus 115A of FIGS. 2 and 3. Differences between the embodiment of FIGS. 4 to 6 and the embodiment of FIGS. 7 and 8 are as follows. In the embodiment of FIGS. 7 and 8, the flow control apparatus 115A also includes a sealing interface 406 that effects sealing, or substantial sealing, of fluid communication between the fluid pressure responsive surface 140 and the housing passage 125. The flow control apparatus 115A of FIGS. 7 and 8 includes a sealing interface-conditioning actuator 402 configured for effecting a change in condition of the sealing interface 406 from a non-defeatable condition to a defeatable condition. While the sealing interface 406 is disposed in the defeatable condition, defeating of the sealing interface 406 is effectible in response to communication of a pressurized fluid. After the defeating of the sealing interface 406, fluid communication becomes effectible between the housing passage 125 and the fluid responsive surface 140 (not shown) of the flow control member 114. In this respect, the flow control member 114 becomes displaceable from the closed position to the open position in response to the communication of fluid pressure from the housing passage 125 to the fluid responsive surface 140.

The actuator 402 is configured to effect a change in condition of the sealing interface 406 from a non-defeatable condition to a defeatable condition in response to sensing by sensor 150 of a control signal that is addressed to the flow control apparatus 115A. In the example of FIGS. 7 and 8, the control signal is a sealing interface actuation ("SIA") signal, detected by the sensor 150. In this context, "non-defeatable" does not mean that the sealing interface 406 cannot be defeated for all purposes, but under normal operating conditions, the sealing interface is not defeatable, and, at minimum, the sensing of the SIA signal by the sensor 150 effects a change in condition such that the sealing interface transitions to a relatively more defeatable condition, and defeatable upon application of fluid pressure during normal operating conditions). In some embodiments, for example, the SIA signal is transmitted through the wellbore 102. In some of these embodiments, for example, the SIA signal is transmitted via fluid disposed within the wellbore 102.

As noted above on respect of SID signal, in some embodiments, for example, the SIA signal can also be implemented as one or more pressure pulses. In some embodiments, for example, the SIA signal is defined by a pressure pulse characterized by at least a magnitude. In some embodiments, for example, the pressure pulse is further characterized by at least a duration. In some embodiments, for example, the SIA signal is defined by a pressure pulse characterized by at least a duration.

In some embodiments, for example, the control signal (e.g. SID signal in the embodiment of FIGS. 4 to 6 and SIA signal in the embodiment of FIGS. 7,8) is defined by a plurality of pressure pulses. In some embodiments, for example, the control signal is defined by a plurality of pressure pulses, each one of the pressure pulses characterized by at least a magnitude. In some embodiments, for example, the control signal is defined by a plurality of pressure pulses, each one of the pressure pulses characterized by at least a magnitude and a duration. In some embodiments, for example, the control signal is defined by a plurality of pressure pulses, each one of the pressure pulses characterized by at least a duration. In some embodiments, for example, each one of pressure pulses is characterized by time intervals between the pulses.

In the embodiment of FIGS. 7,8, in some examples, the flow control apparatus 115A includes a valve member 408, and the sealing interface 406 is defined by sealing, or substantially sealing, engagement between the valve member 408 and the housing 120. In this respect, the change in condition of the sealing interface 406 is effected by a change in condition of the valve member 408. Also in this respect, the actuator 402 is configured to effect a change in condition of the valve member 408 (in response to the sensing of the SIA signal by the sensor 150) such that the sealing interface 406 becomes disposed in the defeatable condition. In this respect, while the sealing interface 406 (defined by the sealing, or substantially sealing, engagement between the valve member 408 and the housing 120) is disposed in the defeatable condition (the defeatable condition having been effected in response to the change in condition of the valve member 408, as above-described), in response to receiving communication of a pressurized fluid, there is a loss of the sealing, or substantially sealing, engagement between the valve member 408 and the housing 120. As a result, there is a loss of sealing, or substantially sealing, engagement between the valve member 408 and the housing 120, such that the sealing interface 406 is defeated, and such that fluid communication is established between the housing passage 125 and the fluid responsive surface 140.

In some embodiments, for example, the valve member 408 includes a valve sealing surface 408A configured for effecting the sealing, or substantially sealing, engagement between the valve member 408 and the housing 120. In this respect, the sealing, or substantially sealing, engagement between the valve member 408 and the housing 120 is effected by the sealing, or substantially sealing, engagement between the valve sealing surface 408A and a housing sealing surface 2202. Also in this respect, the change in condition of the valve member 408 is such that the valve sealing surface 408A becomes displaceable relative to the housing sealing surface 2202 for effecting a loss of the sealing, or substantially sealing, engagement between the valve sealing surface 408A and the housing sealing surface 2202, such that the sealing interface 404 is defeated and such that fluid communication is established between the housing passage 125 and the fluid responsive surface 140. Also in this respect, the loss of the sealing, or substantially sealing, engagement between the valve member 408 and the housing 120, that is effected in response to receiving communication of a pressurized fluid while the valve member 408 is disposed such that the valve sealing surface 408A is displaceable relative to the housing sealing surface 2202, includes the loss of the sealing, or substantially sealing, engagement between the valve sealing surface 408A and the housing sealing surface 2202.

In some embodiments, for example, the flow control apparatus 115A further includes a passageway 4270, and the passageway 410 extends between the housing passage 125 and the fluid responsive surface 140. The valve member 408 and the passageway 427 are co-operatively disposed such that the fluid communication between the housing passage 125 and the fluid responsive surface 140 is established in response to the displacement of the valve member 408 relative to the passageway 427, effected in response to the sensing of the SIA by the sensor 150. Sealing, or substantial sealing, of the passageway 427 is effected by the sealing or substantially sealing, engagement between the valve member 408 and the housing 120 (and, in some embodiments, for example, the valve sealing surface 408A and the housing sealing surface 2202). Also in this respect, sealing, or substantially sealing, of fluid communication between the housing passage 125 and the fluid responsive surface 140 is effected by the sealing or substantially sealing, engagement between the valve member 408 and the housing 120 (and, in some embodiments, for example, the valve sealing surface 408A and the housing sealing surface 2202).

In some embodiments, for example, the actuator 402 includes a squib, and the change in condition of the sealing interface 406 (and also, in some embodiments, for example, the valve member 408) is effected by an explosion generated by the squib in response to sensing of the SIA signal through the sensor 150. In some embodiments, for example, the squib is suitably mounted within the housing 120 to apply the necessary force to the valve member 408. Another suitable valve actuator 402 is a fuse-able link or a piston pusher.

In some embodiments, for example, the change in condition of the valve member 408 includes a fracturing of the valve member 408. In the embodiment illustrated in FIG. 8, the fracture is identified by reference numeral 412. In some embodiments, for example, while the valve member 408 is disposed in a fractured condition, in response to receiving communication of a pressurized fluid, a loss of the sealing, or substantially sealing, engagement between the valve member 408 and the housing 120 is effected, such that there is an absence of sealing, or substantially sealing, engagement between the valve member 408 and the housing 120, and such that the sealing interface 406 is defeated and such that fluid communication is established between the housing passage 125 and the fluid responsive surface 140.

In those embodiments where the change in condition of the valve member 408 includes a fracturing of the valve member 408, in some of these embodiments, for example, the valve member 408 includes a coupler 408B that effects coupling of the valve member 408 to the housing 120 while the change in condition is effected. In some embodiments, for example, the coupler 408B is threaded to the housing 120. In those embodiments where the valve member 408 includes a coupler 408B, in some of these embodiments, for example, the valve member 408 and the actuator 402 are defined by an exploding bolt 414, such that the exploding bolt 414 is threaded to the housing 120. In some embodiments, for example, the squib is integrated into the bolt 414.

In some embodiments, for example, the flow control apparatus 115A further includes first and second chambers (only the first chamber 416 is shown). The first chamber 416 is disposed in fluid communication with the fluid responsive surface 140 for receiving pressurized fluid from the housing passage 125, and the second chamber is configured for containing a fluid and disposed relative to the flow control member 114 such that fluid contained within the second chamber opposes the displacement of the flow control apparatus 115A that is being urged by pressurized fluid within the first chamber 416, and the displacement of the flow control member 114 is effected when the force imparted to the flow control member 114 by the pressurized fluid within the first chamber 434 exceeds the force imparted to the flow control member by the fluid within the second chamber. In some embodiments, for example, the displacement of the flow control member 114 is effected when the pressure imparted to the flow control member 114 by the pressurized fluid within the first chamber 416 exceeds the pressure imparted to the flow control member by the fluid within the second chamber. In some embodiments, for example, the fluid within the second chamber is disposed at atmospheric pressure.

In some embodiments, for example, both of the first and second chambers are defined by respective spaces interposed between the housing 120 and the flow control member 114, and a chamber sealing member is also included for effecting a sealing interface between the first and second chambers while the flow control member 114 is being displaced to effect the opening of the one or more ports 118.

As noted above in respect of the actuation system of the embodiment shown in FIGS. 4 to 6, embodiments of the actuation system of the flow control apparatus 115A of FIGS. 7,8 also include control assembly. The control assembly includes a controller configured to receive a sensor-transmitted signal from the sensor 150 upon the sensing of the SIA signal and, in response to the received sensor-transmitted signal, supply a transmitted signal to the actuator 402. In some embodiments, for example, the controller and the sensor 150 are powered by a battery that is disposed on-board within the flow control apparatus 115A. Passages for wiring for electrically interconnecting the battery, the sensor 150, the controller and the actuator 402 are also provided within the apparatus 115A.

In some embodiments, flow control member 114 may also be displaceable from the open position to the closed position. For example, flow control apparatus 115A may include a closing actuation system configured to cause flow control member 114 to be urged toward the closed position. The closing actuation system may be substantially similar to the opening actuation systems depicted in FIGS. 4 to 6 and 7, 8, except with a fluid responsive surface oriented in the opposite direction, so that pressure acting on the fluid responsive surface urges flow control member 114 in the opposite direction.

As described above, urging of flow control member 114 between its respective positions may be caused by pressurized fluid within passage 125. Alternatively, in some embodiments, flow control member 114 may be urged between its respective positions by pressurized fluid generated by a pressurized fluid generator, such as a squib. Examples of such configurations are disclosed in co-pending U.S. patent application Ser. No. 15/151,799, published as US patent application publication no. US 2016/0333679, the entire contents of which are incorporated herein by reference.

Figure 9:
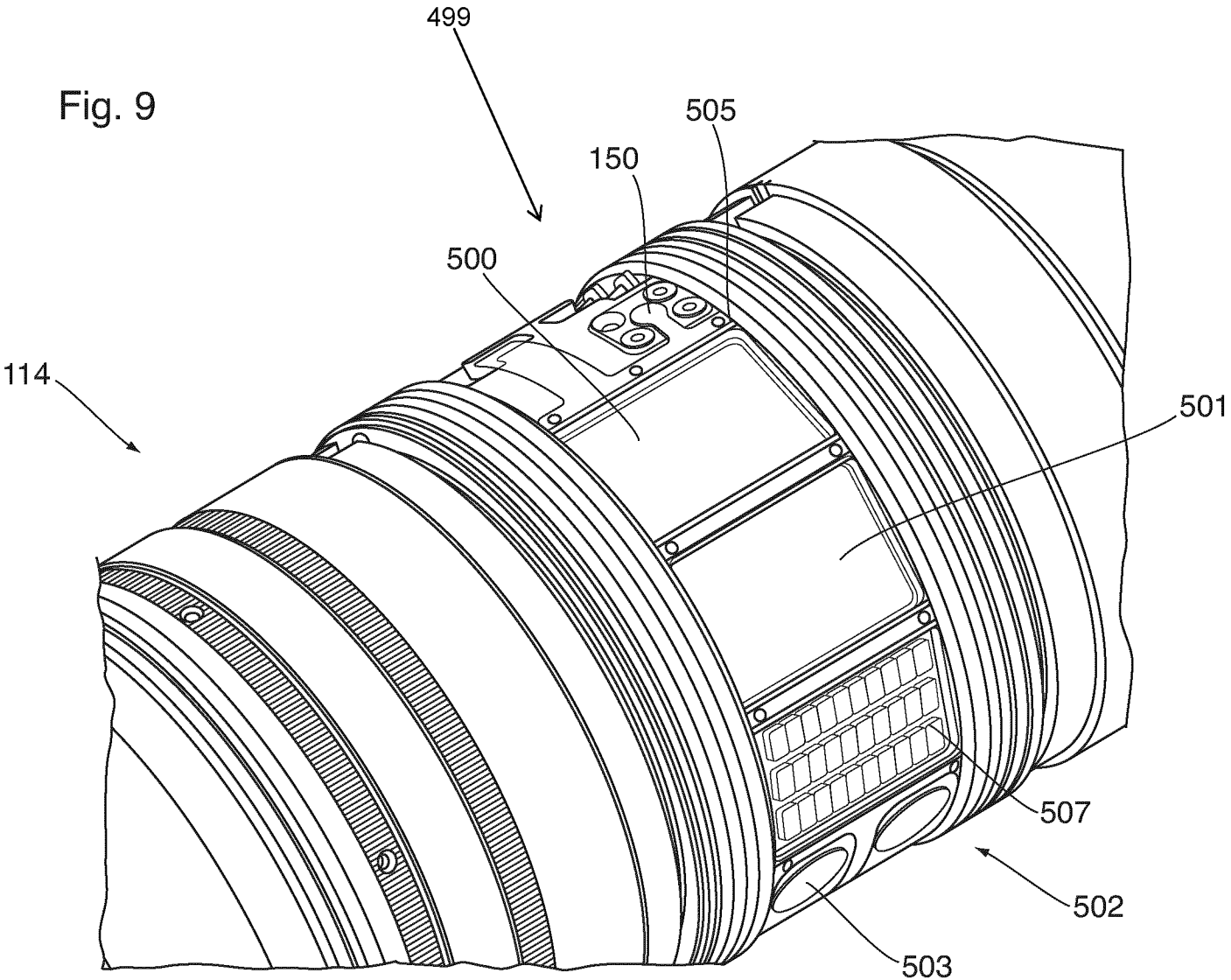
FIG. 9 is an isometric view of a flow control member, with a controller assembly.
Figure 10:
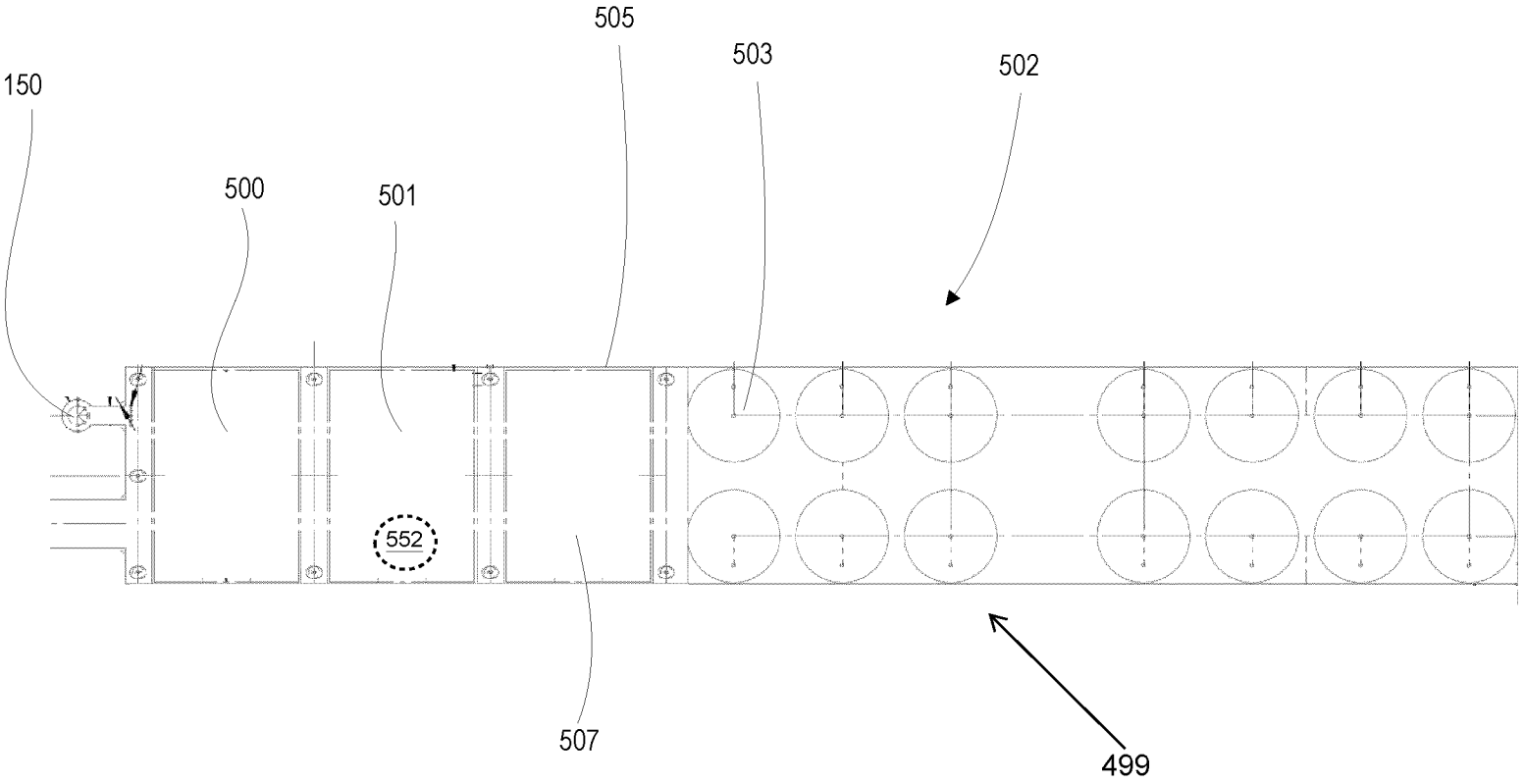
FIG. 10 is a plan view of the controller assembly of FIG. 9.

A control assembly and a process implemented by the control assembly to program and control an actuating system such as those described above in respect of FIGS. 4 to 6 and 7, 8 will now be described with reference to FIGS. 9 through 17. FIG. 9 depicts an example flow control member 114 with a control assembly 499 including a first controller 500, and a second controller 501. FIG. 10 depicts a plan view of the control assembly 499. First controller 500 is electrically connected with a power source 502 (e.g. one or more batteries) and is connected in data communication with sensor 150 that is configured to detect a downhole control signal such as SID or SIA signal (sensor 150) not shown in FIGS. 9-10). Second controller 501 is also electrically connected with power source 502 and is further connected in data communication with at least one additional sensor or transceiver, referred to as transceiver 504 that is configured to receive signals for programming/addressing the control assembly. Transceiver 504 may be of the same or different type as sensor 150 and both sensor 150 and transceiver 504 may include multiple sensors of different types. For example, sensor 150 and transceiver 504 may each include acoustic sensors such as microphones; piezoelectric sensors capable of detecting seismic vibrations; ultrasound sensors; electromagnetic sensors; pressure sensors; RFID sensors; or a combination thereof.

In the depicted embodiment, power source 502 includes a plurality of batteries 503 and a bank of capacitors 507. Capacitors 507 electrically communicate with batteries 503, which maintain capacitors 507 in a charged state. First controller 500 may selectively cause capacitors 507 to discharge, providing an output trigger current to actuator 302/402. Capacitors 507 are capable of discharging more quickly than batteries 503. Thus, capacitors 507 are capable of providing brief power surge sufficient to ignite an explosive device such as a squib.

Controllers 500, 501 and power source 502 are received in a recess within flow control member 114. Controllers 500, 501 and power source 502 may be mounted on a carrier 505, e.g. a printed circuit board within the recess. In the depicted embodiment, the recess is an external annular recess on flow control member 114 and carrier 505 extends around flow control member 114 in the recess. Carrier 505 may be sufficiently flexible to wrap around flow control member 114.

Sensor 150 may be mounted to and communicate with first controller 500 by way of carrier 505. Sensor 150 may be received in a through hole in flow control member 114, such that it is exposed to fluid in wellbore string passage 119.

In other embodiments, one or more of first and second controllers 500, 501 and power source 502 may each be received in different recesses.

First controller 500 communicates with an actuator system that is used to effect opening and or closing of flow control member 114, e.g. by a wired or wireless connection. For simplicity, controller 500 is described herein with reference to interactions with actuator 402 of the actuator system of FIG. 7,8. However, controller 500 may additionally or alternatively be used in devices with fluid communication actuators 302 of the actuator system of FIGS. 4 to 6, or other types of actuators, and therefore references to actuator 402 should be understood to refer to other suitable types of actuators.

Second controller 501 communicates with first controller 500. For example, as described in further detail below, in some embodiments, second controller 501 receives programming instructions and communicates with first controller 500 to cause first controller 500 to operate according to the programming instructions.

Figure 11A:
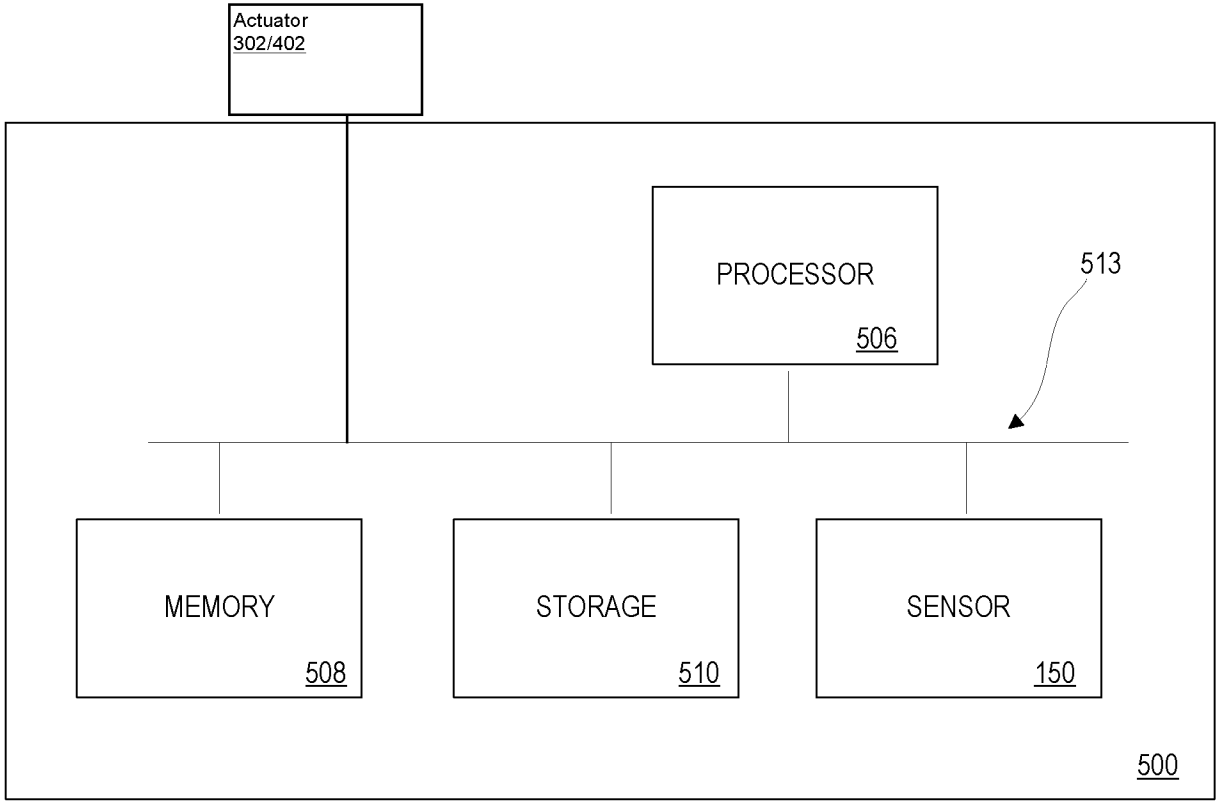
FIGS. 11A, 11B are schematic views of hardware components of the controllers of the controller assembly of FIG. 9.

FIG. 11A is a block diagram of example components of first controller 500. The components shown in FIG. 11A may be part of one or more semiconductor chips. As shown, first controller 500 includes a processor 506, memory 508, storage 510, and one or more input/output (I/O) devices 512. The components may communicate with one another, e.g. by way of a bus 513. In the depicted embodiment, the I/O devices 512 include sensor 150.

Figure 11B:
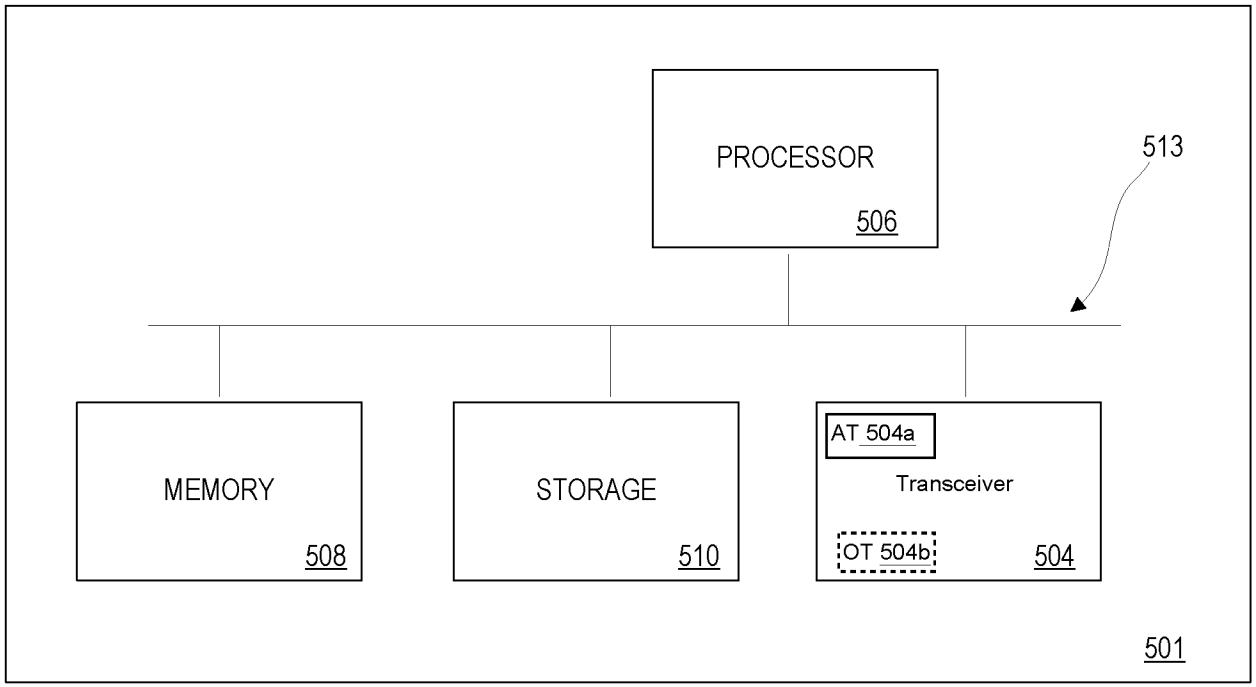

FIG. 11B is a block diagram of example components of second controller 501. The components shown in FIG. 11B may be part of one or more semiconductor chips. As shown, second controller 501 includes a processor 506, memory 508, storage 510, and at least one transceiver 504. The components may communicate with one another, e.g. by way of a bus 513. In the depicted embodiment, the I/O devices include a transceiver 504.

Figure 12:
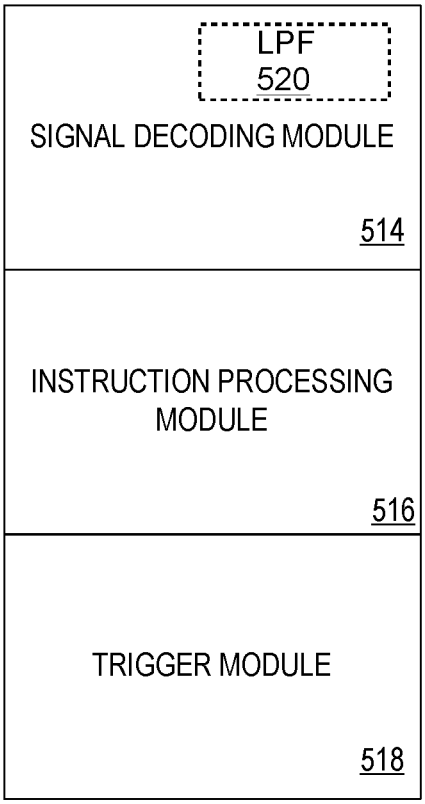
FIG. 12 is a block diagram of software at the controllers of FIGS. 11A-11B.

FIG. 12 is a block diagram of logical modules at controllers 500, 501. The logical modules may be implemented in any suitable combination or hardware and software. For example, the modules may be implemented in software stored in storage 510 for execution by processor 506. Alternatively, one or more logical modules may be implemented in specialized hardware circuits on one or more semiconductor chips.

As shown in FIG. 12, controllers 500, 501 each have a signal decoder module 514, an instruction processing module 516, and a trigger module 518. Signal decoder module 514 converts signals received by sensor 150, transceiver 504 into instructions readable by instruction processing module 516. Instruction processing module 516 parses the instructions and determines if the actuator should be activated. Trigger module 518 selectively causes transmitter 512-2 to output a signal for activating actuator 402.

In an example embodiment, transceiver 504 include an acoustic transceiver 504*a*, capable of receiving and producing an output indicative of vibrations at frequencies in the sonic range (e.g 500 Hz to 2 kHz) or the ultrasound range (e.g. over 20 kHz), and of generating vibrations at frequencies in the sonic range or the ultrasound range. Sensor 150 is a pressure transducer capable of detecting and producing an output indicative of changes in fluid pressure in wellbore string passage 119.

Control signals may be passed to first controller 500 (and in some examples, second controller 501) through wellbore string passage 119 by inducing fluid pressure changes in wellbore string passage 119. For example, pressure changes may be introduced in wellbore string passage 119, by opening valve 123 of wellhead 117 and control messages may be encoded in the pressure changes, such as the magnitude and rate of the pressure change. In example embodiments, valve 123 is opened and closed by a wellhead controller 640. Wellhead controller 640 may be implemented as a programmable logic controller, PC or other similar control device that controls a valve actuator of valve 123 to generate and transmit the control messages. As described in greater detail below, the control messages may be encoded as packetized messages (referred to herein as Downhole Data Units (DDUs)) that each comprise multiple symbols that are each encoded as a respective pressure change rate.

In an example, the first controller 500 of each flow control apparatus 115A may be assigned a unique identification value, which may be an 8-bit numerical value, e.g. from 0 to 255. A master transmitter at the surface may transmit a control signal down wellbore string passage 119, instructing a specific one of flow control apparatuses 115A to open. The signal may be the numerical identification value of the corresponding first controller 500. Each first controller 500 is programmed with a unique identification value, which may also be referred to as an address. Programming of the unique identification value may be done prior to insertion of controller 500 in a recess within flow control member 114. As noted, in some embodiments, transceiver 504 includes an acoustic transceiver 504*a* that is capable of detecting acoustic vibrations, including acoustic vibrations in the sonic range (e.g. 500 Hz to 2 kHz) or the ultrasound frequency range (e.g. over 20 kHz). Second controller 501 may be programmed using acoustic (e.g. sonic or ultrasound) vibrations. Specifically, vibrations may be transmitted to flow control apparatus 115A and received by transceiver 504 and controller 501, Instructions may be encoded in the vibrations, and decoded by signal decoding module 514 and instruction processing module 516 of controller 501. Second controller 501 may then pass instructions to first controller 500 to program first controller 500. In some examples, the instructions sent via acoustic (e.g. sonic or ultrasound) vibrations received by transceiver 504 of second controller 501 include assignment of an identification value or address for first controller 500.

Conveniently, while housing 120 may attenuate electromagnetic and certain other types of signals, sonic or ultrasound vibrations may pass relatively easily through housing 120. Accordingly, programming may be performed with controller 501 and transceiver 504 fully enclosed by housing 120. Conversely, programming by wired connection or by sending electromagnetic signals may require physical access to controller 500 or 501 or transceiver 504.

Sonic or ultrasound vibrations may be transmitted to a acoustic transceiver 504*a* through housing 120 using a programming apparatus including a suitable sonic or ultrasound transducer under control of a programmable logic controller, PC or other similar control device. For example, vibrations may be delivered using a piezoelectric or capacitive transducer positioned against a surface of housing 120. Alternatively, vibrations may be generated remotely, e.g. by vibration of a diaphragm and transmitted through a medium such as air to housing 120. Transceiver 504 may include a speaker and a microphone.

In some embodiments, messages may be sent by sonic or ultrasound vibrations. Numerical values, such as hexadecimal values may be encoded as pairs of frequencies, which are transmitted. On receipt of a signal by transceiver 504, signal decoding module 516 of controller 501 converts the signal into the corresponding numerical value, e.g. using a lookup table.

Instructions may be sent to controller 501 as packetized messages. Such messages are passed to instruction processing module 518 of controller 501 and parsed into computer-readable instructions. Instructions may include assignment of an address. In some embodiments, controller 501 and transceiver 504 are capable of generating reply messages, such that full duplex communication can occur between controller 501 and an external programming device via sonic or ultrasound vibrations. In such embodiments, instructions sent to controller 501 may include queries, such as battery or operating condition queries, and replies may include data such as battery charge, temperature, charge cycles and the like, and any error messages stored at controller 501.

Conveniently, controllers 500 and 501 may be programmed at the surface, immediately prior to insertion of each flow control apparatus 115A in the wellbore. Thus, controllers 500 may be addressed sequentially in an order corresponding to their insertion order (and thus, to their respective positions along the wellbore). For example, address values may be incremented for each flow control apparatus 115A inserted in the wellbore, such that the controller 500 with the lowest address value is inserted first and becomes positioned at the treatment zone closest to the well toe, and such that the subsequent controllers 500 in the uphole direction define a sequence of address values.

In some alternative examples, assigning an address to a controller 500 may comprise reading a unique identifier from the flow control apparatus 115(A) (using an RFID reader, for example) that has been pre-assigned to the controller 500 and mapping that unique identifier to a sequential address value. In such a configuration, wellhead controller 640 could be programmed to map a sequential address that is assigned during downhole installation to a controller 500 to the controller's pre-assigned unique identifier. During operation, the wellhead controller 640 can use a lookup table to translate the sequential address to its mapped unique identifier that is then used in the DDU payload to signal the controller 500. Such a mapping procedure may reduce the programming required for controllers 500, 501 of flow control apparatuses 115A.

In some example embodiments, instead of or in addition to an acoustic transceiver 504*a*, the transceiver 504 of second controller 501 includes an optical sensor or interface

504*b* (FIG. 11B) that is aligned with an optical port 552 (see FIG. 10) that provide a line of sight from an outside of the controller assembly to the optical interface 504*b*. The optical interface 504*b* can be used as an interface for providing pre-installation instructions to controller 501 (including assignment of a unique address for controller 500) in the same manner as described above in respect of acoustic transducer 504*a*. For example, a suitable optical transducer under control of a programmable logic controller, PC or other similar control device could be aligned with the optical port 552 to send encoded light messages to the optical interface 504*b* for decoding by controller 501. In some examples the optical medium may be one or more of infrared light, visible light or ultraviolet light. In some examples optical port 552 may be a sight glass. The use of a non-contact line of sight programming system may be beneficial in some applications.

Once inserted in the wellbore, control signals (such as sealing interface-defeating (SID) signals or sealing interface actuation (SIA) signals) may be encoded in one or more DDUs and transmitted to the first controller 500 of each flow control apparatus 115A. The control signals may be encoded and transmitted by manipulation of fluid pressure within wellbore string 116. In particular, with wellbore string passage 119 filled with fluid, the fluid pressurized, and the pressure then relieved by opening a valve 123 in wellhead 117, e.g. to vent air to atmosphere or to route fluid from wellbore string passage 119 to a reservoir or production conduit. Release of pressure in this manner gradually reduces the pressure of fluid remaining in wellbore string 116 and thereby produces a pressure curve. As noted, opening of valve 123 is variable, such that the rate of pressure relief is likewise variable. Thus, the shape of the pressure curve can be modulated to encode instructions for first controller 500. For example, opening of valve 123 may be controlled to produce a rate of pressure change in any of a set of discrete predetermined values. The resulting pressure curve is monitored by first controller 500 and messages in the pressure curve are decoded by controller 500.

Specifically, signal decoder module 514 of first controller 500 periodically obtains measurements of fluid pressure in wellbore passage 119 from sensor 150. Measurements may be obtained, for example, by polling sensor 150 at a particular frequency, maintained e.g. by a clock signal. Based on the periodic pressure measurements, signal decoder module 514 determines a rate of pressure change in wellbore passage 119 and decodes the measured rate of pressure change to a corresponding numerical value.

Figure 13:
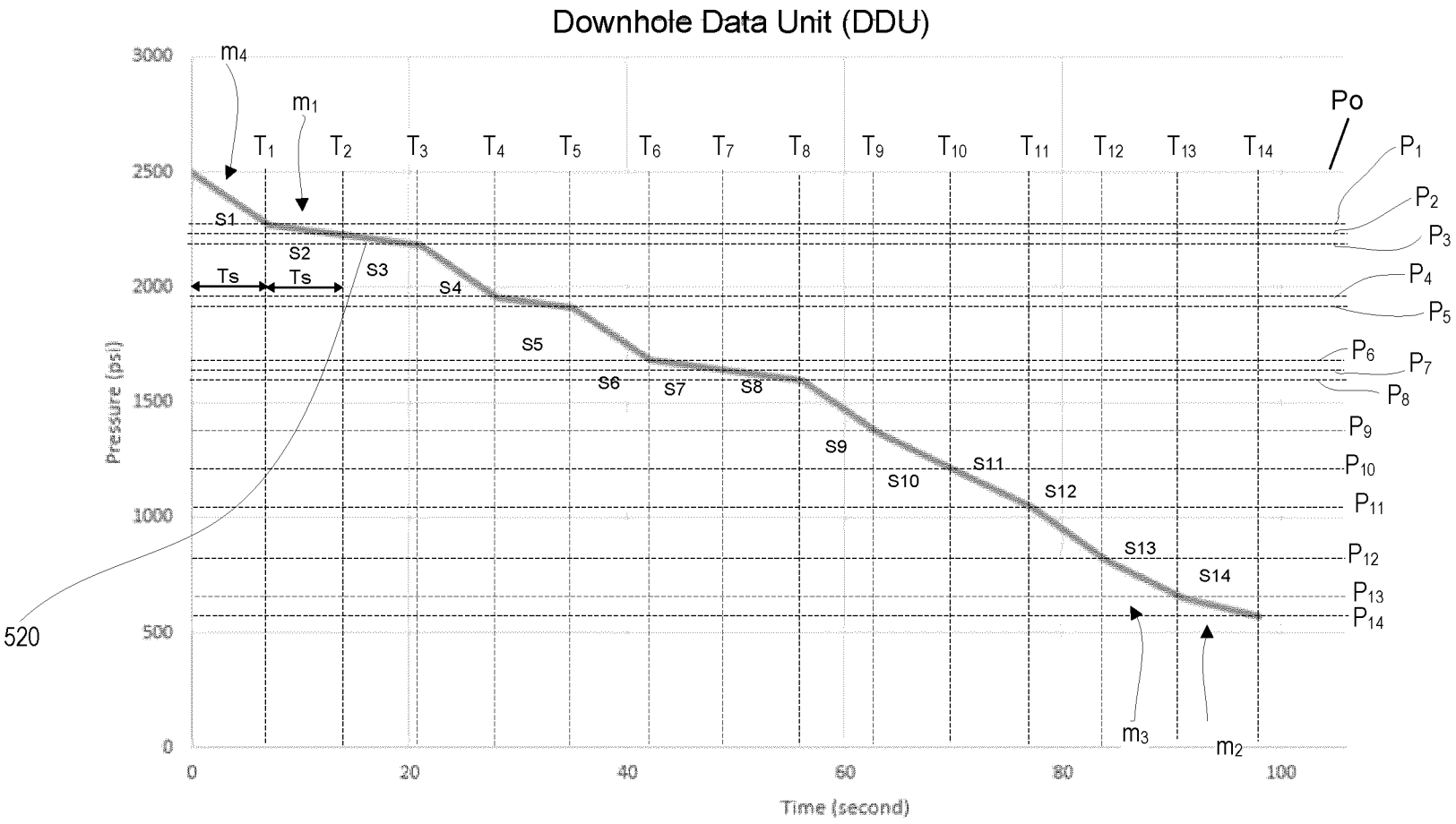
FIG. 13 is a plot of a pressure profile representative of a modulation scheme for signaling a controller.

FIG. 13 depicts an example modulated pressure curve 520. As depicted, pressure in wellbore string 116 is initially approximately constant, at pressure $P_0$. In some examples, pressure $P_0$ is approximately 2500 psi. Pressure is relieved in a sequence of stages by operation of valve 123. That is, at each stage, valve 123 is opened or closed to a specific opening state. In some examples, valve 123 may be opened to any of four possible states, e.g., 25% open, 50% open, 75% open and 100% open. As will be apparent, the amount of opening of valve 123 controls the rate at which pressure is relieved from wellbore string passage 119—a large opening, such as 100% open will relieve pressure at a faster rate than a small opening, such as 25%. Thus, each of the four discrete opening states produces a corresponding rate of pressure relief.

As shown in FIG. 13, pressure in wellbore string passage 119 is relieved in 14 stages, ending at times $T_1$ through $T_{14}$, respectively. During each stage, valve 123 is set to one of four opening states and creates a pressure curve at one of four possible slopes (rates of pressure change) $m_1$, $m_2$, $m_3$ and $m_4$. For example, during the first stage, from $T_0$ to $T_1$, valve 123 is 100% open and produces a slope of $m_4$. During the second stage, from $T_1$ to $T_2$, valve 123 is 25% open and produces a slope of $m_1$. During the thirteenth stage, from $T_{12}$ to $T_{13}$, valve 123 is 75% open and produces a slope of $m_3$. During the fourteenth stage, from $T_{13}$ to $T_{14}$, valve 123 is 50% open and produces a slope of $m_2$.

As noted above, first controller 500 measures pressure in wellbore string passage 119 using sensor 150. For example, controller 500 may periodically poll sensor 150 for measured pressure values. Based on the polling frequency and reported pressure values, controller 500 can determine changes in pressure over time, e.g. by constructing a log of pressure measurements.

In an example, controller 500 is configured to determine an average rate of pressure change over a time interval T of predetermined length. For example, as depicted in FIG. 13, the time interval between each of $T_1$, $T_2$ . . . $T_{14}$ is seven seconds. However, in other embodiments, the time interval may be shorter or longer.

Controller 500 is configured to compare the pressure measured at the beginning and end of each time interval in order to determine the rate of pressure change during the interval. For example, the rate of change between $T_1$ and $T_2$ may be determined by dividing the difference between $P_2$ and $P_1$ by the time elapsed between $T_1$ and $T_2$. The resulting value may be matched to one of $m_1$, $m_2$, $m_3$ or $m_4$. Such matching may be done, for example, by measuring the actual slope of curve 520 during a time interval, and determining the closest one of slopes $m_1$, $m_2$, $m_3$ and $m_4$ to the actual slope. Alternatively, for a constant time interval, the rate of pressure change may be classified based on the measured pressure change during the interval. That is, pressure may be measured at the beginning and the end of each time interval, and the difference compared to threshold values, without explicitly calculating a rate of change. In such embodiments, slopes m1, m2, m3 and m4 may be replaced with pressure values rather than rates of change.

Thus, the rate of pressure change may be modulated to encode signals. In the embodiment of FIG. 13, valve 123 is configured to open in one of four discrete stages, and controller 500 is configured to differentiate between four discrete rates of pressure change. Accordingly, signals may be encoded into base-four numbers, such that each value encoded as a rate of pressure change is between zero and four, i.e. two binary bits. As depicted, slope m1 is assigned a value of zero, or binary 00; slope m2 is assigned a value of 1, or binary 01; slope m3 is assigned a value of 2, or binary 10; and slope m4 is assigned a value of 3 or binary 11. The term "symbol" is used herein to refer to a digit in a particular number system, e.g. a binary 0 or 1 or base-4 0, 1, 2 or 3.

Other configurations are possible. For example, controller 500 could be configured to differentiate between two possible rates of pressure change, rather than four and signals could be encoded and transmitted as binary, rather than quaternary numbers. In other embodiments, systems greater than base-four may be used, subject to the ability of valve 123 to produce different rates of pressure change and the ability of controller 500 and sensor 150 to resolve pressure change into discrete levels.

Messages transmitted through wellbore passage 119 may include, for example, instructions for controller 500 of one or more flow control apparatus 115A. Messages may further include training and synchronization signals and error correction information.

As shown, curve 520 has fourteen stages, corresponding to a sequence of fourteen quaternary (base-four) numbers. Accordingly, curve 520 represents an downhole data unit (DDU) that consists of 14 symbols (S1 to S14), with each symbol representing one of four possible values. Table 1 shows the sequence of intervals, slopes and corresponding base-four numbers for the curve 520 of FIG. 13, which represents an DDU that encodes the following sequence of 14 values (3, 0, 0, 3, 0, 3, 0, 0, 3, 2, 2, 3, 1, 1).

TABLE 1

| Downhole data unit (DDU) | | | |
|---|---|---|---|
| Interval (Symbol) number | Ending time | Slope | Encoded value |
| 1 | T1 | m4 | S1 = 3 |
| 2 | T2 | m1 | S2 = 0 |
| 3 | T3 | m1 | S3 = 0 |
| 4 | T4 | m4 | S4 = 3 |
| 5 | T5 | m1 | S5 = 0 |
| 6 | T6 | m4 | S6 = 3 |
| 7 | T7 | m1 | S7 = 0 |
| 8 | T8 | m1 | S8 = 0 |
| 9 | T9 | m4 | S9 = 3 |
| 10 | T10 | m3 | S10 = 2 |
| 11 | T11 | m3 | S11 = 2 |
| 12 | T12 | m4 | S12 = 3 |
| 13 | T13 | m3 | S13 = 2 |
| 14 | T14 | m2 | S14 = 1 |

Values assigned to each of slopes m1 through m4 may for example be stored in a look up table maintained in memory 508 (FIG. 11A) by controller 500.

In some embodiments, messages transmitted through wellbore passage 119 are encoded using error correction methods designed to correct for substitution of symbols in the received message. For example, in the embodiment of FIG. 13, the message transmitted in the 14 symbol DDU represented by pressure curve 520 includes an address or identification number between 0 and 255 that unique identifies a flow control apparatus 115A. A number between 0 and 255 can be represented as 8 binary bits or 4 quaternary (base-four) symbols. For example, the decimal number 125 may be encoded as a base-four number 1331.

However, curve 520 includes 14 stages, corresponding to 14 quaternary symbols. As will be explained in further detail, the first four symbols (S1 to S4) are preamble symbols used for synchronization and training of controller 500. The remaining ten symbols (S5 to S14) form a 10 symbol payload word used for error-tolerant encoding of the address.

Address values may be converted into code words using a forward error-correction algorithm. In some embodiments, such algorithms may be allow for correction of up to 3 incorrectly-received symbols (i.e. three incorrectly-measured slopes) in each 10-symbol word.

Generally, the amount of error tolerance of a message encoded with an error-correction algorithm depends on the length of the encoded data word. Specifically, longer encoded data words are often tolerant to a greater number of errors. However, longer words may take longer to transmit. Moreover, the number of symbols that can be transmitted through wellbore passage 119 as described above is limited by the amount of pressure that can be relieved from wellbore passage 119. In some examples, error tolerance up to three substituted symbols provides adequate performance, and encoding using binary Golay codes provides adequate transmission performance. However, in some embodiments, a greater or smaller degree of error correction may be desired.

As noted, some symbols transmitted via wellbore passage 119 may be used for synchronization and training of controller 500. For example, as shown in FIG. 13, the first four symbols (S1 to S3) are used for synchronization and training. The synchronization and training signals may be a pre-set sequence of symbols, which may be programmed into first controller 500 prior to installation.

In some embodiments, first controller 500 may have multiple modes, e.g. a low-power listening mode and a higher-power measuring mode. Controller 500 may obtain pressure measurements (e.g. by polling sensor 150) at different frequencies in the listening and measuring modes. While in the listening mode, controller 500 may poll sensor 150 at a low frequency (for example 1 Hz). While in the measuring mode, controller 500 may poll sensor 150 at a higher frequency (for example 10 Hz). Obtaining pressure measurements at higher frequency may improve accuracy, but may consume battery power at a greater rate. Controller 500 may generally operate in the listening mode in order to conserve battery power and may switch to the measuring mode only in response to an instruction, e.g. an instruction signal send via wellbore passage 119.

Controller 500 may be configured to transition from the listening (low-power) mode to the measuring (higher power) mode upon detecting a transition signal via sensor 150. The signal may be one or more pre-programmed symbols sent by way of a pressure change in wellbore passage 119. For example, as depicted, controller 500 is configured to transition to the measuring (higher power) mode upon detection of the predetermined symbol sequence of base-4 symbols 3,0. Accordingly, in example embodiments, the first two symbols S1, S2 in an DDU are used to signal controller 500 to transition from low power listening mode to high power measuring mode. That is, controller 500 transitions from low power mode to the measuring mode upon detecting a pressure change that corresponds to a predetermined symbol sequence, namely a pressure change at a rate equivalent to slope M3, followed by pressure change at a rate equivalent to slope M0. Additionally, the first two symbols S1, S2 in an DDU are used as synchronization symbols, such that upon detection of the pre-programmed symbols, controller 500 may begin timing. As noted, signals are send by modulation of pressure changes through specific time intervals that each represent one symbol such that each DDU has a duration of 14 time intervals. In order to accurately measure pressure changes, measurement of time intervals at controller 500 must be synchronized with operation of valve 123. Thus, upon initial detection of the predetermined combination of symbols 3,0, controller 500 may sync its internal clock with the timing of the received symbols.

Signals transmitted via wellbore passage 119 may also include training signals for calibrating controller 500 and sensor 150, and in example embodiment, symbols S3 and S4 of the DDU are assigned as training symbols.

Based on characteristics of wellhead 117, valve 123, wellbore passage 119 and other factors, estimated values of slopes $m_1$, $m_2$, $m_3$, $m_4$ (i.e. the expected rate of pressure change with valve 123 25%, 50%, 75% and 100% open) may be determined (e.g. by numerical analysis or empirical testing) and programmed into controller 500. However, the actual rates of pressure change may vary during operation, for example due to changes in valve 123 or wellbore passage 119 over time. Therefore, calibration may be performed to correct the pre-programmed values based on actual operating conditions.

In the depicted example, training signals (symbols S3, S4) are sent following the synchronization signals (symbols S and S2). Thus, the training signals are sent during the third and fourth intervals of the transmission, i.e. between $t_2$ and $t_3$ and between $t_3$ and $t_4$. The training signals are signals of a known level, e.g. the symbols S1 and S2 have values that are known to the controller 500. As shown, the rate of pressure change between $t_2$ and $t_3$ is $m_1$ (representing a value 0) and the rate of pressure change between $t_3$ and $t_4$ is $m_4$ (representing a value of 3) In other words, in the first training interval (symbol S3), valve 123 is operated to produce the smallest possible rate of pressure change. In the second training interval (symbol S4), valve 123 is operated to produce the largest rate of pressure change used for signalling purposes.

Controller 500, using sensor 150, measures and determines the pressure change during each time interval and determines the actual maximum and minimum rates of change created when valve 123 is 100% and 25% open, respectively. The measured rates may differ from pre-programmed rates, in which case corrected values may be stored, e.g. in a look up table. Intermediate rates of change $m_2$ and $m_3$ may be determined based on the measured values of $m_1$ and $m_4$. For example, rates of change $m_2$ and $m_3$ may be interpolated between the measured values of $m_1$ and $m_4$, such that the four discrete thresholds are evenly spaced.

Figure 14A:
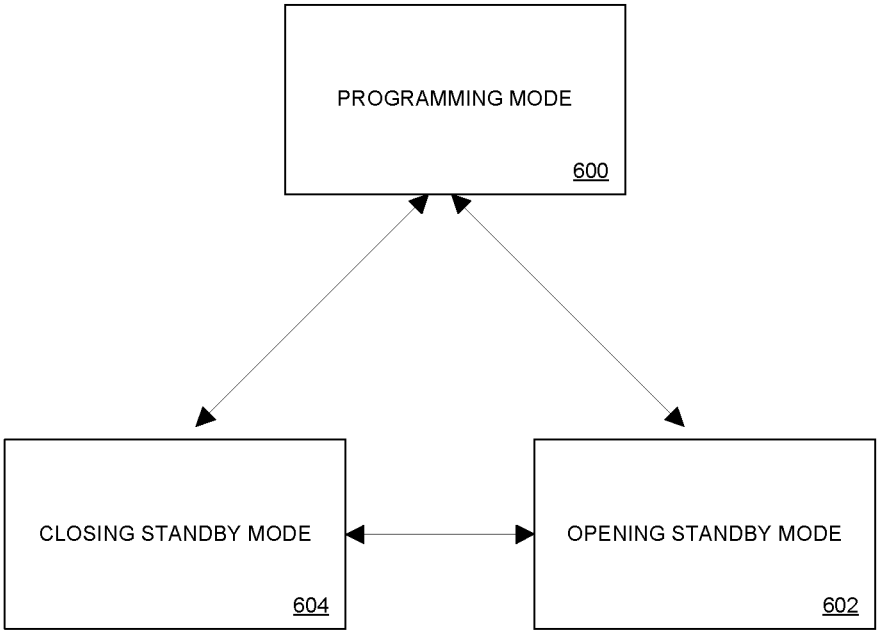
FIG. 14A is a schematic diagram of modes of operation of a controller.

Rates of change $m_1$, $m_2$, $m_3$ and $m_4$, as corrected based on measured values, may be stored by controller 500, for example in a look up table in storage 508. Accordingly, training symbols S2 and S3 of DDU have predetermined values, allowing controller 500 to calibrate the measured pressure values to symbol values to allow accurate decoding of the subsequent payload symbols S5 to S14 of the DDU Controller 500 may be operated in a plurality of modes corresponding to programming, and opening and closing of flow control member 114. Operation of controller 500 may in some embodiments be characterized as a state machine, for example, as shown in FIG. 14. For example, as shown, controller 500 may be operated in a programming mode 600; an opening standby mode 602 and a closing standby mode 604.

Controller 500 may be directed to enter the programming mode by an instruction from a programming apparatus, e.g. controller 501. In some embodiments, controller 500 may be configured to respond to an instruction to enter the programming mode 600 while in any mode of operation.

On receipt of an instruction to enter programming mode 600, instruction processing module 516 may cause an acknowledgement message to be sent. Instruction processing module 516 may listen for a further message defining an address value. Once the next message is received, the message may be parsed (i.e. converted or decoded to an address value) and the address value may be stored in storage 510 for later use. Instruction processing module 516 may then cause a further acknowledgement to be sent using transceiver 512 and may then enter an opening standby mode.

In the opening standby mode, controller 500 polls sensor 150 in its low-power listening mode, e.g. at a low frequency. Pressure changes in wellbore passage 119 are detected and signal decoding module 514 checks for values encoded in pressure changes. In the event a pre-programmed synchronization signal (in the embodiment of FIG. 13, encoded symbol values 3, 0) is detected, controller 500 enters a measuring (higher-power) mode, in which sensor 150 is polled at an increased frequency.

Controller 500 then continues to poll sensor 150 to monitor pressure changes in wellbore passage 119. In some examples, training symbols S3, S4 are used to calibrate pressure change levels to symbol values. Sensed pressure changes over the remainder of the signal are decoded by signal decoding module 514 to recover payload symbols S5 to S14. Error correction coding is applied to recover an address, and the decoded address message is provided to instruction processing module 516. Instruction processing module 516 checks the received message against the stored address value. If a received message matches the stored address, instruction processing module 516 causes trigger module 518 to produce a signal for activating actuator 402 to effect movement of flow control member 114 to its open position. The signal may be a voltage provided from capacitors 507 by way of a wired connection.

Once flow control member 114 is opened, fluid may be injected into formation 100 by way of the flow control apparatus 115A for treatment of the formation to stimulate production. Injection may continue for a period of time, after which it may be desired to close flow control apparatus 115A prior to injection through another flow control apparatus 115A. Such closing may be prompted by a control signal sent from the surface. Therefore, after opening, controller 500 may therefore transition to a closing standby mode 602. The control signal may comprise an acoustic signal intended for the transceiver 504 of second controller 501, one or more pressure pulses in wellbore string passage 119 intended for pressure sensor 150 of first controller 500, or both. In some embodiments, an acoustic closing signal may be sent, having frequency in the ultrasound range (e.g. >20 kHz) or in a lower range (e.g. 500 Hz to 2 kHz).

In some embodiments, the closing signal may be a standard signal common to all controllers 500 and/or 501, such that when a closing signal is sent, all controllers 500 receiving the signal (either directly or indirectly from controller 501) cause the associated flow control members 114 to move to their closed positions.

In other embodiments, closing signals may be specific to each controller 500. For example, the closing signals may correspond to each controller's unique address value, or may be based on such value.

Acoustic closing signals, including acoustic signals in the sonic range or the ultrasound frequency range, may be received by transceiver 504, decoded and provided to signal processing module 516 of controller 501 and transmitted to controller 500 to act on. Closing signals may alternatively or additionally be sent using pressure pulses, which may be received by sensor 150 of controller 500 directly, decoded and provided to signal processing module 516 of controller 500.

Signal processing module 516 of controller 500 checks the decoded signals, and if a signal matches a stored closing instruction, signal processing module 516 causes trigger module 518 to activate a closing actuator to effect movement of flow control member 114 to its closed position.

In some embodiments, in the closing standby mode, signal decoding module 514 and signal processing module 516 of controllers 500, 501 may monitor for signals indicative of specific operating conditions. For example, fluid injection for treatment of formation 100 may be noisy due to operation of pumps, flowing of fluids and entrained particles and the like. Moreover, pressure within wellbore string passage 119 may be elevated. Accordingly, during such time, transceiver 504 may receive vibrations associated with such noise and produce an output signal indicative of such noise, and sensor 150 may produce an output indicative of elevated pressure. In certain conditions, such as equipment failure, pumping may be stopped, leading to a reduction in noise level and pressure. During such conditions, it may be desired to effect movement of flow control member 114 to its closed position to prevent outflow of fluid into formation 100. Accordingly, controller 500 may be programmed, in a closing standby mode, to monitor for drops in one or more of measured sound level and measured pressure. In the event of such a drop, signal processing module 516 may cause trigger module 518 to generate a signal to effect movement of flow control member 114 to its closed position by activation of a closing actuator. In some embodiments, a closing actuator may be activated in this manner only if both the measured sound level and measured pressure drop at approximately the same time.

In the example described above in respect of FIG. 13, the DDU has a set of specified parameters including: the number of possible values represented by each symbol (e.g. modulation levels M=4), the duration of each symbol (e.g. $T_S$=7 seconds), the number of symbols in each DDU (e.g. N=14), the allocation of these symbols between preamble (e.g. 2 synchronization symbols and 2 training symbols) and payload symbols (e.g. 10 symbols containing address information or other data or instructions), and the type of forward error correction (FEC) coding applied (e.g. Gray coding). As suggested above, in different example embodiments, one or more of these parameters can be changed to achieve different performance criteria. For example, reducing the number of possible values that can be encoded into a symbol and increasing the symbol duration may result in more robust signalling system that is simpler to modulate at the well head and less susceptible to noise as the signal decoding module 514 will not have to distinguish between as many pressure rate change slopes and will have a longer period over which to assess pressure changes. The increased accuracy comes at the cost of reduced downhole data communication capacity per DDU, but in many applications this trade-off may be justified. In at least some examples the parameters will be influenced by characteristics of the installation such as the length of the borehole string, the number of flow stations in the borehole string, and sources of noise that could adversely affect the pressure sensing done at downhole stations.

In this regard, in an alternative example embodiment the number M of possible values encoded in each symbol is reduced to two (M=2), such that each of the N symbols S1 to S14 is a binary symbol. In the example case where binary symbols are used, signal decoding module 514 is configured to associate a first rate of pressure change (slope $m_1$) over a symbol duration $T_s$ with one binary value (for example a logic 1) and a second rate of pressure change (slope $m_2$) with a second binary value (for example a logic 0). In one example, valve 123 is switched between a predefined open position (for example 100% open) and a closed position to generate the two slopes $m_1$ and $m_2$, such that slope $m_1$ is the rate of pressure change associated with valve 123 being in an open position for at least a portion of a symbol duration and slope $m_2$ corresponds to valve 123 being in a closed position for a symbol duration. In example embodiments, valve 123 is opened and closed by a wellhead controller 640, which is implemented by a digital computer configured to control a valve actuator of valve 123. In at least some examples, wellhead controller 640 may include similar components arranged in a configuration similar to that shown in FIGS. 11A and 11B in respect of first and second controllers 500, 501, with the addition of an actuator component for controlling opening and closing of valve 123.

Figure 14B:
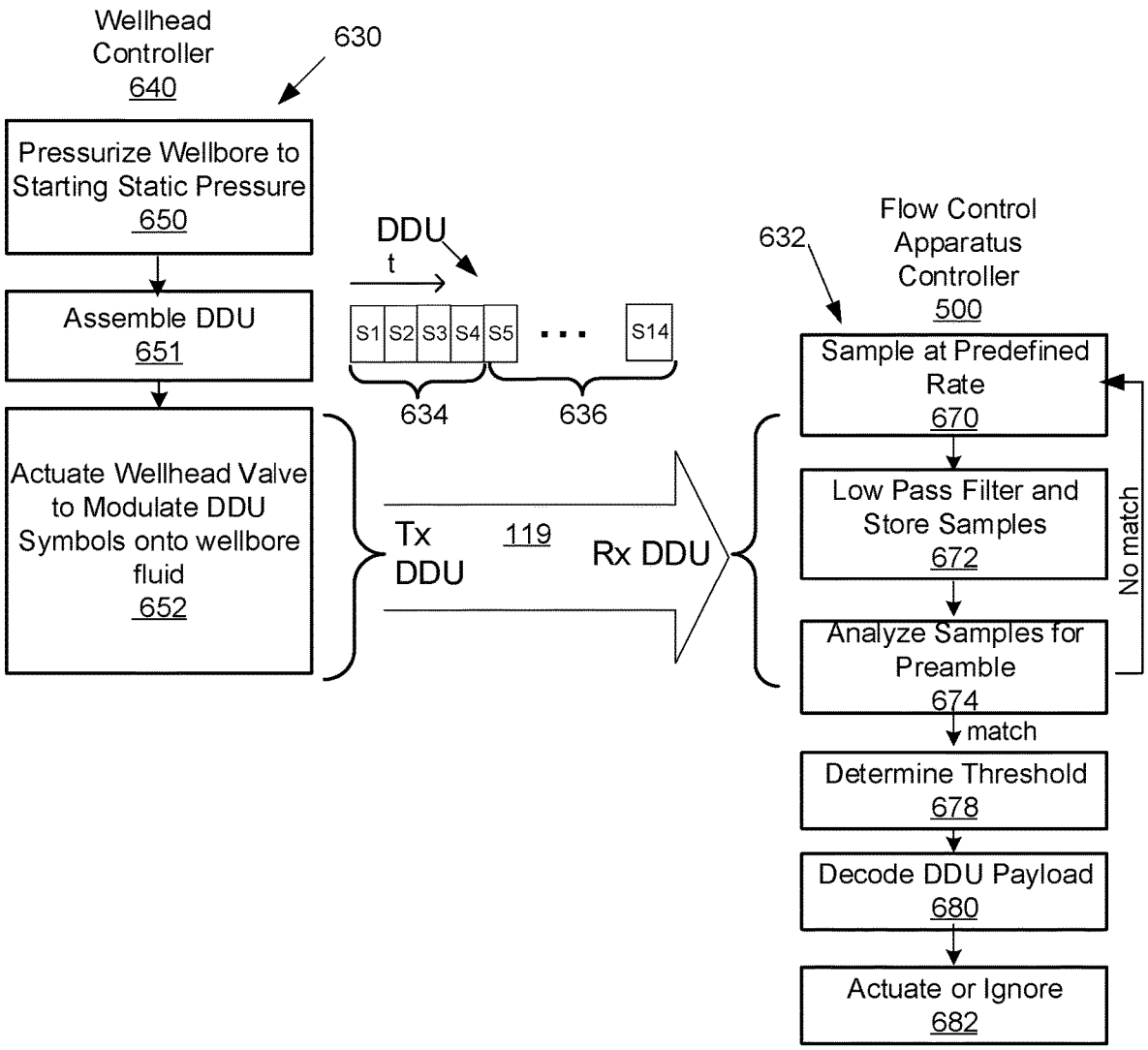
FIG. 14B is a flow chart depicting processes taken at a wellhead controller and a flow control apparatus controller according to an example embodiment.

FIG. 14B illustrates a further example of transmitting and receiving control signals through the borehole string passage 119. In particular, FIG. 14B shows an example of a process 630 at wellhead controller 640 to encode and transmit a DDU, and a process 632 at a controller 500 of a flow control apparatus 115A to receive and decode the DDU. As indicated by step 650, process 630 begins with pressurization of the wellbore string passage 119 through the addition of fluid to a predetermined initial static pressure level (for example, $P_0$≈2500 psi). Wellbore string passage pressurization step 650 may be controlled by a separate controller than wellhead controller 640. Wellhead controller 640 monitors or is notified of the pressure conditions in the wellbore passage 119.

At some point after well passage pressurization, wellhead controller 640 determines (for example, through operated initiated instructions) that a control message needs to be transmitted to a specified flow control apparatus 115A in the wellbore string. The control message may for example be an instruction for the flow control apparatus 115 to change from its current flow control state (for example closed) to a different state (for example open). As indicated at step 651, the wellhead controller generates the control message by assembling a multi-symbol DDU that, in at least some example includes a preamble 634 and a payload 636. In the example of a binary symbol DDU, each symbol will have one of two values (for example a "1" or a "0"). As noted above, an initial group of the symbols of the DDU can be used as preamble 634 for encoding a predefined synchronization and training symbol sequence that is known to the controllers 500 of the flow control apparatuses 115A. For example, in one embodiment the first four symbols of a DDU are used for the preamble 634. In one such example, the DDU preamble 634 may be assigned the predetermined sequence of (S1=1, S2=0, S3=0, S4=1). In one example, the DDU payload 636 consists of a fixed length of 10 symbols appended to the preamble 634, such that DDU has a length of 14 binary symbols. In example embodiments, the control message that is encoded into the DDU payload 636 consists of the unique identifier or address of the controller 500 of the target flow control apparatus 115A that is to be controlled. As noted above, FEC coding may be applied by the wellhead controller 640 to the contents of the control message included in payload 636 to allow the message to be recovered at the flow control apparatus controller 500 based on only a sub-set of the payload symbols.

Once the DDU is assembled, the wellhead controller 640 transmits the DDU downhole by pressure modulating the fluid contained in the wellbore string passage 119. As described above, and indicated in step 652, wellhead controller 640 modulates the wellbore fluid by actuating the wellhead valve 123. In example embodiments, each DDU symbol has a defined symbol duration $T_s$ that is known to both the wellhead controller 640 and the flow control apparatus controller 500, and each DDU has a defined number of symbols N, such that each DDU has a defined DDU duration of ($T_s$×N). In the presently described example embodiment, wellhead controller 640 modulates a binary "1" by causing a valve actuator to open wellhead valve 123 by a predefined amount at the start of a symbol duration Ts, and then subsequently close the valve 123 at a time prior to the end of the symbol duration Ts. In at least some applications, movement of the valve 123 between its defined open and closed positions is not instantaneous and the resulting pressure rate change for each interval will not have a linear slope, contrary to the slopes shown in FIG. 13. In some embodiments, when modulating a "1" symbol, valve 123 is open to release pressure for only part of the symbol duration Ts—for example, less than 75% of the symbol duration Ts. In some examples, valve 123 is open for only approximately the first half of the symbol duration Ts. By way of illustrative example, in the case of symbol S1=1, wellhead controller 640 causes valve 123 to move to its predefined open position at time $T_0$=0, and then, midway through the symbol duration Ts at time=$(T_1-T_0)/2$ wellhead controller 640 causes valve 123 to move to its closed position. Thus, the pressure curve profile during the symbol duration Ts will be steeper over the first half of the symbol duration than the second half of the symbol duration.

In some alternative examples, rather than being strictly time based, wellhead controller may be configured to open valve 123 at the start of symbol duration and then close it within the symbol duration as soon as a predetermined pressure drop has occurred, for example to close valve 123 when the fluid pressure in wellbore passage 119 is measured a having dropped by a threshold psi since the valve was opened. In some examples, valve closing could be triggered once a predetermined volume of fluid has been released through valve 123.

In an example embodiment, wellhead controller 640 causes wellhead valve to stay closed for the entire duration Ts to modulate a binary "0" symbol. In step 652, the wellhead controller 640 causes the valve 123 to be opened and closed as required to modulate all of the successive symbols S1 to S14 of the DDU as pressure rate changes in the fluid of wellbore string passage 119.

In some examples, the amount of time that valve is open during a symbol duration may be varied to apply a higher modulation level than binary.

On the DDU receiving side, in an example embodiment, controller 500 of each flow control apparatus 115A in the wellbore string 116 performs process 632 to detect and decode DDUs transmitted through the wellbore string passage 119. In example embodiments the controller 500 is pre-informed of the DDU parameters that have been used at the wellhead for encoding, including symbol duration Ts, number N of symbols in a DDU, the number and content of the symbols (e.g. S1 to S4) that make of preamble sequence 638, the level of encoding used (e.g. M=2 in the case of binary), and the target pressure drop per non-zero symbol duration (for example 100 PSI). The controller 500 is unaware of exactly when to expect a DDU, and in this regard in some examples the signal decoding module 514 of controller 500 is configured to repeatedly perform steps of sampling (step 670), filtering and storing the samples (step 672) and analyzing the samples for preamble symbols (step 674).

Regarding sampling step 670, controller 500 is configured to monitor sensor 150 to sample fluid pressure in wellbore string passage 119 at a predetermined sampling rate (SR). As noted above, an example of a sampling rate is 1 Hz·h Thus the number of samples per symbol (NSS) will be symbol duration Ts divided by sampling rate SR. In example embodiments, the signal decoding module 514 is configured to implement a low pass filter 520 (see FIG. 12) to remove noise from samples collected at step 670. In particular, in an example where valve 123 is repeatedly actuated between open and closed positions to pressure modulate the wellbore fluid, an unwanted effect can be the creation of a pressure pulses due to a fluid hammer effect (commonly called a water hammer) caused by the valve movement. The repeated opening and closing of valve during modulation of a DDU can further worsen the fluid hammer effect progressively over the transmission time for a DDU. Typically, however, noise modulated onto the wellbore fluid as a result of the fluid hammer effect will have a higher frequency than the DDU modulation frequency.

Accordingly, as indicated in step 672, in example embodiments the measured pressure samples are filtered using a low pass filter with a predefined cut-off frequency. The cut-off frequency may in at least some examples be preconfigured to be lower than noise caused by the fluid hammer effect and higher than the symbol modulation frequency. The frequency of noise caused by the fluid hammer effect may be dependent on factors specific to an particular wellbore string installation, such as wellbore string length, and thus in some embodiments the cut-off frequency of LPF 520 is one of the parameters of controller 500 that can be configured on site when the controller is in its programming mode 600.

As indicated in step 672, the filtered samples are stored for analysis by the controller 500 in controller memory 508 and/or storage 510. The analysis performed by controller 500 to recover symbols is a comparative process in which data derived from successive groups of samples is compared against reference thresholds. In at least some examples, accuracy can be improved by storing a large number of samples for analysis, and accordingly in example embodiments the controller 500 is configured to maintain the stored samples in a table of samples for a duration that exceeds a DDU duration.

As indicated in step 674, in an example embodiments the controller 500 is configured to analyze the filtered stored samples to determine if the preamble 634 of a DDU has been received. In example embodiments, the controller 500 may do this by calculating an average pressure drop across successive sample sets that correspond to a symbol duration (for example sets that each include NSS samples) and determining a pressure drop over each set until a pressure drop profile is detected that matches the leading symbols of DDU preamble 634. For example, in the case of preamble bits S1=1, S2=0, controller 500 can scan the table to locate a pattern of successive samples that include: samples that show a reasonably consistent static pressure (for example 2500 psi), followed by a group of NSS samples (corresponding to symbol duration Ts at a sampling rate SR) that show a cumulative pressure drop across the that exceeds a predefined threshold, followed by a subsequent group of NSS samples that shows a pressure drop across the group that is below a predefined threshold. In such examples, the predefined threshold may be set with a wide tolerance for the preamble symbols, for example the predefined threshold for predicting a "1" may be a pressure drop in excess of Y psi in the case where the actual drop at the wellhead was 2 Ypsi) and the predefined threshold for predicting "0" may be a pressure drop of less than Y psi. In some example, the thresholds could be different for predicting "1" or a "0". a In some example embodiments, upon determining that a match has been found for in the table of data samples for preamble bits S1=1, S2=0, the controller will then determine the pressure drops across the next two successive 15 sample groups to confirm if they correspond to the next two preamble bits (e.g. S3=0, S4=1). In example embodiments, if a match for the preamble symbols of the DDU is located by the controller 500 in its table of stored samples, the controller concludes that a DDU has been received and that the following samples in the table correspond to the symbols of the DDU payload 636. Accordingly, at the successful conclusion of step 674 the controller 500 can reasonable predict that a DDU has been located, and has synchronized the symbols S1 to S14 of the DDU with respective groups of corresponding samples stored in the sample table.

Referring to step 678, in some examples, prior to decoding the payload symbols (e.g. S5 to S14) from the data samples, the controller 500 is configured to determine more accurate thresholds for classifying the symbols. As noted above, in at least some examples threshold training can be done based on the pressure drops calculated across some of the preamble symbols (for example S3 and S4 can be used as training symbols for this purpose). However, in at least some measurements the controller is configured to further refine the classification thresholds based on the data samples stored in its data table for the entire DDU payload. Accordingly, in an example embodiment, in step 678 the controller 500 determines a refined classification threshold by: (a) based on the stored data samples, calculating a respective pressure drop across each of the symbol durations that correspond to respective payload symbols S5 to S14; (b) doing a preliminary symbol classification by comparing the calculated pressure drops across each symbol duration to a preliminary threshold (for example the same threshold used to predict the preamble bits or a threshold determined based on preamble training bits), to predict how many of the payload symbols S5 to S14 are "1"s and how many are "0"s; (c) calculate the total pressure drop across all of the symbols (S5 to S14) of the DDU payload 636; and (d) divide the total pressure drop by the number of payload symbols S5 to S14 that preliminarily classified as ones to calculate an average threshold to use as the refined classification threshold. In some examples, the preamble symbols can also be included when determining the average threshold to use as the refined classification threshold.

In at least some examples, the refined classification threshold is stored by controller 500 to use as the starting threshold value for detecting preamble symbols in future DDUs received by the controller 500.

As indicated in step 680, the signal decoding module 514 of controller 500 applies the refined classification threshold to classify each of the payload symbols (S5 to S14) as a "1" or "0" to recover the symbols of DDU payload 636, and FEC decoding is carried out to recover the bits of the original control message. At step 682, the recovered control message is parsed by the instruction processing module 516 of controller 500 to determine if it is an instruction for that particular controller 500 (for example, is it the unique address of the controller 500). If not, the controller 500 ignores the message. However, if the instruction processing module 516 determines that controller 500 is the addressed recipient of the message, trigger module 518 is instructed to take the appropriate actuation action.

Figure 15:
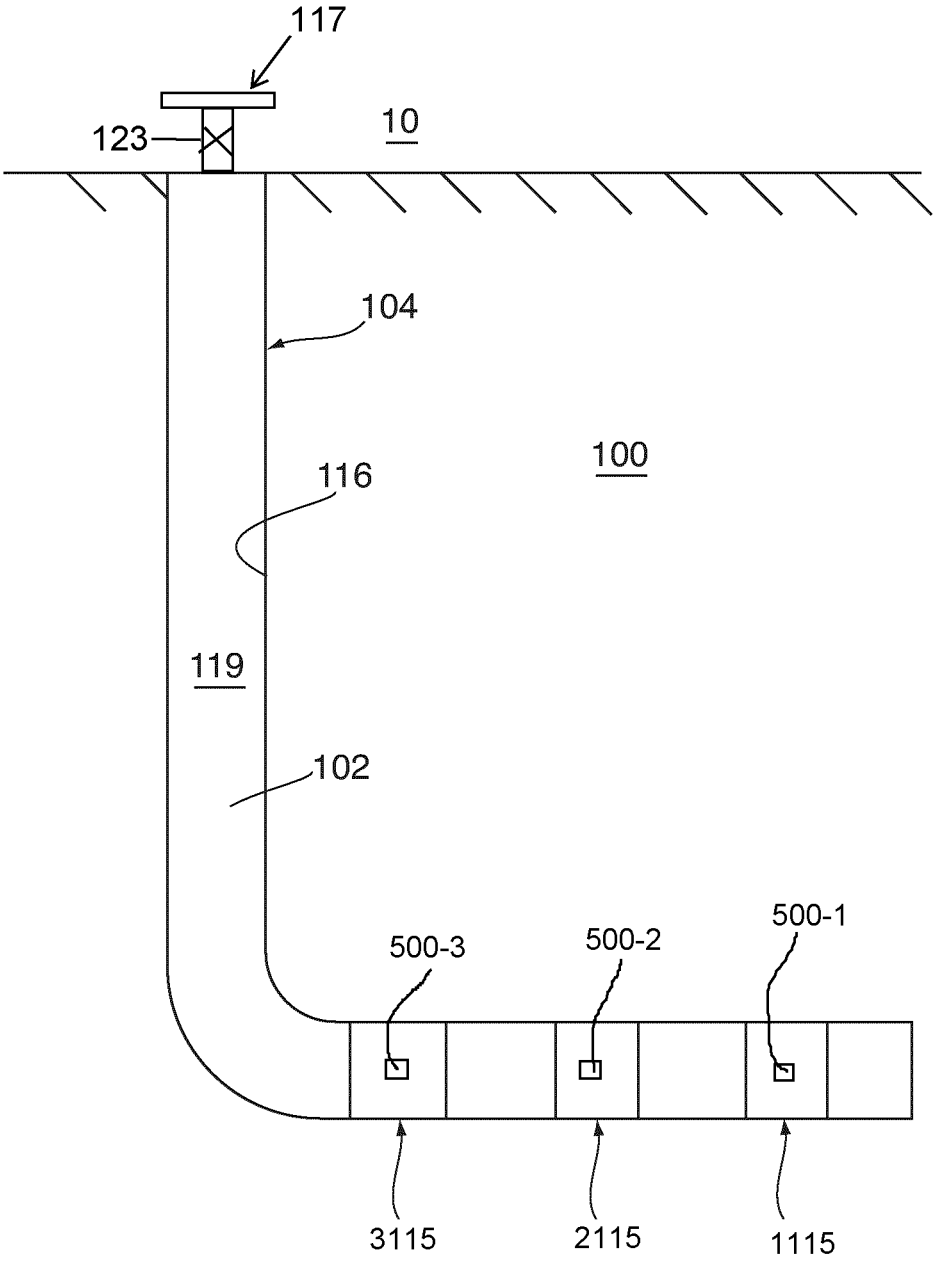
FIG. 15 is a schematic illustration of a system for effecting fluid communication between the surface and a subterranean formation via a wellbore, with flow control apparatus having controllers at multiple locations.

An example of a process for stimulating production of hydrocarbon material from a subterranean formation 100 via a wellbore material transfer system 104 including three or more flow communication stations 1115, 2115, and 3115 (as shown in FIG. 15) will now be described. The description which follows is with reference to embodiments where the number of flow communication stations is three (3), and is defined by a first flow communication station 1115, a second flow communication station 2115, and a third flow communication station 3115. It is understood that the number of flow communication stations 115 is not limited to three (2) and may be any number of flow communication stations 115.

Figure 16:
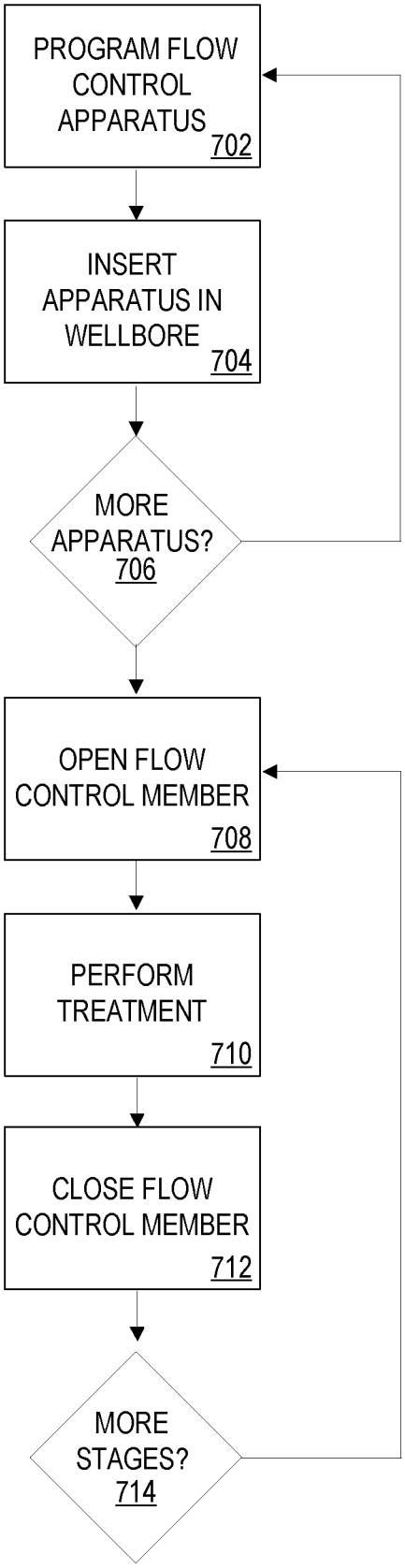
FIG. 16 is a flow chart depicting a process of operating the system of FIG. 15.

Each of flow communication stations 1115, 2115, 3115 is equipped with a controller assembly 499 having controllers 500, 501. FIG. 16 depicts an example method of stimulating production from a system such as that shown in FIG. 15.

At block 702, the flow control apparatus 115A of first flow communication station 1115 is prepared for installation in the wellbore. As part of such preparation, messages are sent to controller 501 by way of transceiver 504 for programming the flow control apparatus, namely, for programming controllers 500, 501 of flow control apparatus 115A.

A programming device with an acoustic (e.g. sonic or ultrasound) transmitter or transceiver is placed in proximity to flow control apparatus 115A. In some embodiments, the transmitter or transceiver may be placed in physical contract with the flow control apparatus 115A. Instructions are then encoded as sequences of acoustic (e.g. sonic or ultrasonic) vibrations. For example, as described above, the instructions may be sent as a series of hexadecimal values encoded and transmitted using DTMF signals. The instructions include an assignment of an identification value or address to the flow control apparatus 115A. In some embodiments, the address is a numerical value, which may be sequentially assigned based on the installed position of the flow control apparatus. That is, values may be assigned sequentially in a downhole-to-uphole direction or in an uphole-to-downhole direction. In an example, the values are 8-bit values, i.e. decimal 0 to 255 and flow control apparatus 115A of first flow communication station 1115 is assigned value 00000000 (decimal 0).

Transceiver 504 receives the instructions as acoustic vibrations. Signal decoding module 514 de-modulates the received signals into instructions readable by controller 501 and passes the instructions to instruction processing module 516. The instructions are then provided from controller 501 to controller 500 for storage and for configuration of controller 500.

Optionally, other instructions may also be provided to controllers 501, 500. Such instructions may include, for example, an instruction to report a battery charge level, an instruction to report any error messages, such as stored error messages, instructions to perform diagnostics, or the like. In some embodiments, one or more response messages may be sent from controllers 500, 501 to the programming device. Responses may likewise be encoded and transmitted as acoustic (e.g. sonic or ultrasound) signals using transceiver 504.

At block 704, flow communication station 1115, including flow control apparatus 115A, is added to wellbore string 116 and inserted in the wellbore. As subsequent components are added to wellbore string 116, flow communication station 115 is advanced downhole toward its installed position.

At block 706, if more flow control apparatus 115A of other flow communication stations are to be installed, the process returns to block 702 for programming of the next flow control apparatus 115A. As noted, the controller 500 of the next flow control apparatus 115A may be programmed with a unique identifier that sequentially precedes or follows the previous flow control apparatus 115A.

Notably, flow control apparatuses 115A may be identical to one another prior to programming with an identification value. Thus, a set of flow control apparatuses may be provided for installation and individual ones of those flow control apparatuses may be selected in an arbitrary order to be programmed and then added to wellbore string 116. As will be apparent, this may ease installation, relative to pre-programmed flow control apparatuses of which individual ones need to be selected and installed in a specific order.

If no more flow communication stations and associated flow control apparatus 115A need to be installed, wellbore string 116 is completed. At block 708, the first fracturing stage is initiated by sending a signal for opening of the first flow control member 115A. As described above, the signal may be a series of quaternary (base 4) symbols, encoded in a modulated pressure profile created by operation of valve 123 of wellhead 117. The signal may include a first preset sequence of symbols for activating a measurement mode and synchronizing controller 500 with the signal, and a second preset sequence of symbols for calibrating controller 500. The signal may be received by a controller 500 of each flow control station 115A within wellbore string 116.

Each controller 500 may be calibrated based on the received preset sequence of symbols. Specifically, the preset sequence of symbols may include a maximum rate of pressure change, caused by operation of valve 123 in a fully-open state, and a minimum rate of pressure change, caused by operation of valve 123 in a minimally-open state. The minimum and maximum rates of pressure change may be stored as threshold values. Additional intermediate threshold values may further be stored, e.g. by interpolation between the minimum and maximum values.

The signal may further include an instruction for opening of the flow control a apparatus 115A of one of the flow communication stations in wellbore string 116. For example, the instruction may be an identification value for a particular controller 500 of a particular flow control apparatus 115A.

As noted, the identification value may be transmitted after encoding according to an error-correction algorithm, so that the value can be successfully received even if one or more symbols is received incorrectly.

Each controller 500 decodes the received message and compares the identification value stored therein against its own value, obtained from controller 501 via an acoustic programming device at block 702. If the received identification value matches the value stored by any specific controller 500, the controller causes triggering of actuator 402.

In the depicted embodiment, at block 708, a first signal (for example a DDU) is communicated downhole containing a unique identification value of controller 500 of flow communication station 1115.

In response to an activation signal from triggering module 518 of controller 500, actuator 402 is activated, allowing the flow control member 114 of the first flow communication station 1115 to be displaced uphole, effecting opening of the one or more ports 118 associated with the first flow communication station 1115. At block 710, treatment of the formation is performed. That is, stimulation fluid is supplied from the surface, conducted through the wellbore string 116 and into the subterranean formation via the opened one or more ports 118 associated with the first flow communication station 1115, thereby effecting stimulation of a first stage.

Figure 17:
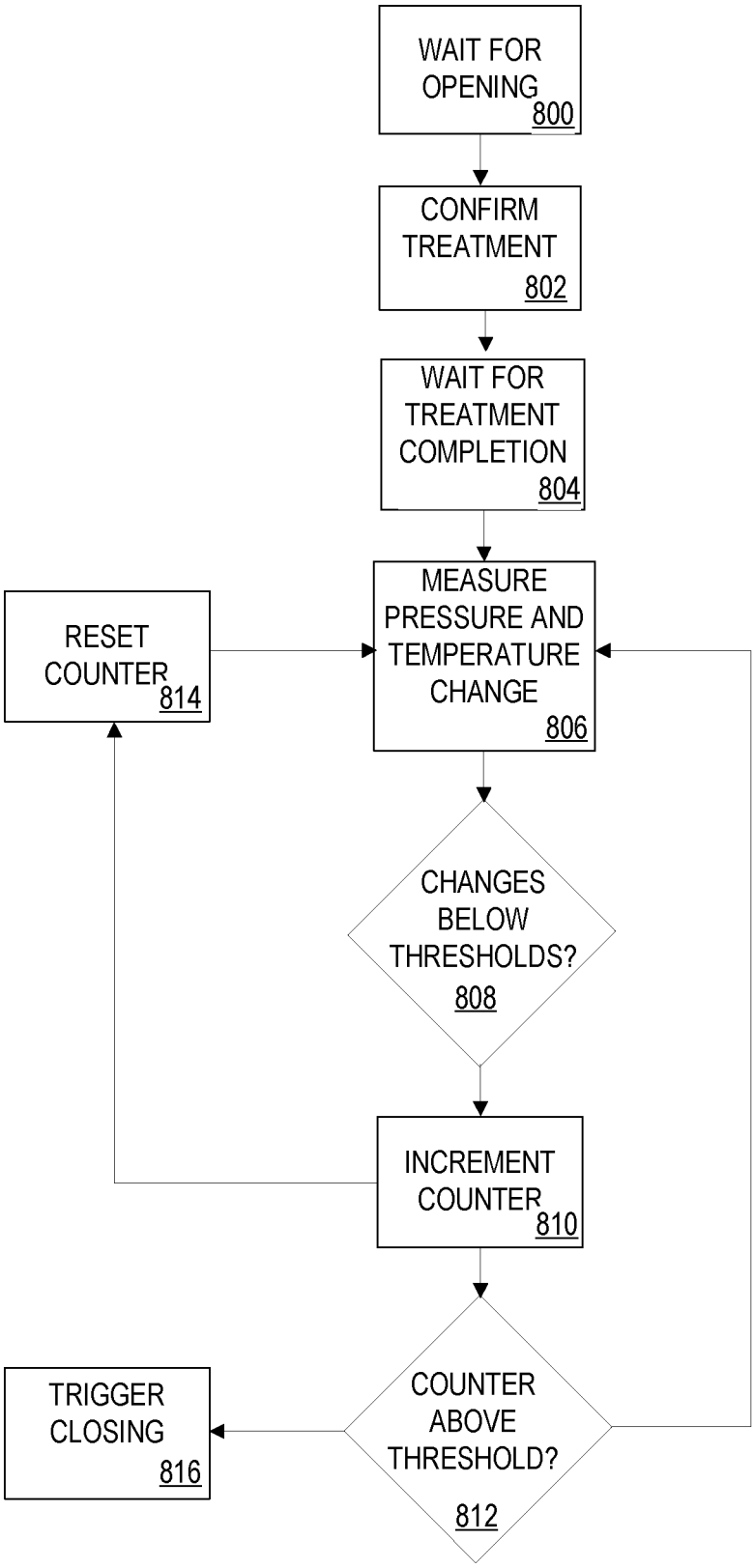
FIG. 17 is a flow chart depicting a process of closing a flow control apparatus of the system of FIG. 15.

At block 710, after triggering of actuator 402, controller 500 transitions to closing standby mode 604 and awaits a closing condition. FIG. 17 depicts an example process of detecting a closing condition.

At block 800, controller 500 waits for a period following activation of actuator 402.

At block 802, controller 500 confirms that the treatment is being successfully carried out. Specifically, the controller 500 obtains a measurement of pressure in wellbore passage 119 using sensor 150 and a measurement of temperature in wellbore passage 119. The wait time at block 800 may be chosen so that the measurements are taken while the treatment operation is expected to be in progress. Pressure and temperature are expected to be within a particular range. For example, if the treatment is a hydraulic fracturing operation, pressure and temperature in wellbore passage 119 are expected to drop after opening of flow control apparatus 115A. If either or both of the measured pressure and temperature is determined to be outside the expected range, an error may have occurred. For example, pressure may be higher than expected if the flow control member 114 is not moved to the open position. In such event, flow control apparatus 115A may be immediately closed by activation of a closing actuator for moving flow control member 114 from its open position to its closed position.

At block 804, controller 500 rests for a second period, selected to permit completion of the treatment stage. In some embodiments, such as for some hydraulic fracturing operations, the wait period may be approximately 15 minutes.

At block 806, controller 500 periodically polls sensor 150 and a temperature sensor for measurements of temperature and pressure in wellbore passage 119. Using measurements over time intervals of a preset length, rates of pressure and temperature change are calculated. and classified as increasing, decreasing or static. In some examples, pressure increase of greater than 30 psi per minute is classified as increasing; pressure decrease of more than −30 psi per minute is classified as decreasing, and pressure change of between −30 psi and 30 psi per minute is classified as static. Temperature increase of more than 1° C. per minute is classified as increasing, temperature decrease of more than 1° C. per minute is classified as decreasing, and temperature change between 1° C. per minute and −1° C. per minute is classified as static.

Increasing pressure or static pressure is associated with injection of treatment fluid. Conversely, decreasing pressure indicates the end of a treatment stage, due to pumping being stopped, Likewise, decreasing or static temperature is associated with an in-progress treatment stage and increasing temperature is associated with the conclusion of a treatment stage.

If pressure is falling and temperature and temperature is increasing or static, and if pressure is static and temperature is increasing, controller 500 determines that a closing condition may exist and proceeds to block 808, at which controller 500 checks the pressure change and the temperature change measured at block 806 against respective threshold values. If both are below the respective threshold values, controller 500 increments a counter at block 810 and proceeds to block 812. If not, controller 500 resets the counter at block 814 and returns to block 806.

At block 812, controller 500 checks if the counter is equal to or above a threshold number, e.g. 5. If so, at block 816, controller 500 triggers a closing actuator of the closing actuation system to close flow control apparatus 115A by moving flow control member 114 to its closed position. If not, controller 500 returns to block 806.

The threshold checks performed at blocks 808 and 812 may guard against false detection of closing conditions. For example, the threshold check at block 808 tests the cumulative changes over a period of time to ensure that transient pressure and temperature readings do not create a false positive reading at block 806. Similarly, the use of a counter and checking of the counter level at block 812 ensures that closing of flow control apparatus 115A is not triggered unless multiple consecutive measurements are indicative of closing conditions at both blocks 806, 808. In some examples, at block 808, controller 500 checks if the pressure change is less than 3.4 MPa and the temperature change is less than 2° C. In some examples, at block 812, controller 500 checks if the counter is 5 or greater.

Moreover, the counter check at block 812 provides an opportunity to cancel a closuring condition. That is, the counter check introduces a delay between the first detection of a closing condition and triggering of closing. During the delay period, closing may be cancelled by eliminating the closing condition, e.g. by activating a pump.

In some embodiments, measurements at any of blocks 806, 808 may further include sound level measurements obtained, e.g. using transceiver 504. Sound levels above a particular threshold may be associated with an ongoing treatment operation. Sound levels below the threshold may indicate the completion of the operation. For example, sound levels may drop significantly in the event of stopping of a treatment pump or failure of a treatment pump. In some embodiments, the sound threshold is added as a further check at one or both of blocks 806, 808. In other embodiments, detection of a low sound level may automatically trigger closing of flow control apparatus 115A or reduce the pre-set threshold values for pressure and temperature change, or change or eliminate the counter threshold check at block 812. In some embodiments, automatic triggering based on low sound level may be overridden by pressure or temperature measurements consistent with ongoing treatment operations. For example, triggering based on low sound levels may be overridden by measurement of increasing pressure.

In some embodiments, automatic closing based on monitoring of wellbore passage conditions may be performed without performing the checks at blocks 808, 812. Rather, closing may be triggered based only on a detection at block 806 of pressure and temperature change rates associated with the end of a treatment operation. Such configurations may increase the risk of closing a flow control apparatus 115A based on false detection of a closing condition.

Referring again to FIG. 15, after the treatment through flow communication station 1115 and closing of its flow control apparatus is completed, a signal is sent to controller 500 of flow communication station 2115. Controller 500 decodes the message as described above and triggers actuator 402 to cause the flow control member 114 of the second flow communication station 2115 to be displaced uphole, effecting opening of the one or more ports 118 associated with the second flow communication station 2115. The act of displacement effects the deformation of the flow control member 114 associated with the second flow communication station 2115 from the passive condition to the interference body-receiving condition. Stimulation fluid is supplied from the surface, conducted through the wellbore string 116 and into the subterranean formation via the opened one or more opened ports 118 associated with the second flow communication station 2115, thereby effecting stimulation of a second stage.

Described above are embodiments in which flow control apparatuses 115A are provided with a single actuator 402 for effecting opening, and in which flow control apparatuses 115A are provided with two actuators for effecting opening and then closing. Such embodiments may be referred to as one-stage and two-stage, respectively. Other embodiments may have any number of actuators, for opening and closing in any number of stages. For example, flow control apparatuses 115A may be configured for any number of alternating open and close stages, controlled as described above. Alternatively, messages sent to controller 500 by modulation of the rate of pressure change in wellbore passage 119 may include additional information, such as a stage number, in order to identify a specific actuator to be activated.

As described above, two separate controllers 500, 501 are provided, in communication with sensor 150 and transceiver 504, respectively. However, in some embodiments, controllers 500, 501 may be replaced by a single controller providing the functions of both controllers 500, 501. The single controller may communicate with both sensor 150 and transceiver 504.

As described above with reference to FIG. 13, signals are encoded in a pressure profile produced by relieving pressure in a sequence of stages of predetermined length, and the slope of the pressure curve during each stage represents a value. Alternatively, stages may be defined by an amount of pressure drop, and values may be encoded in the amount of time elapsed during each stage. For example, each stage may correspond to a 100 psi pressure drop in wellbore passage 119. The length of time required for a 100 psi drop to occur will depend on the rate of pressure change. Thus, for example, four different degrees of opening of valve 123 may produce stages of four corresponding lengths. Controller 500 may therefore measure the amount of time for a defined pressure drop to occur, and each length may correspond to a different encoded value.

In some embodiments, for example, the flow control member 114 is displaceable, relative to the one or more ports 118, in response to an applied mechanical force, such as, for example, a force applied by a shifting tool of a workstring. In some embodiments, for example, the shifting tool is integrated within a bottom hole assembly that includes other functionalities. Suitable workstrings include tubing string, wireline, cable, or other suitable suspension or carriage systems. Suitable tubing strings include jointed pipe, concentric tubing, or coiled tubing. In some embodiments, for example, the workstring includes a passage, extending from the surface, and disposed in, or configured to assume, fluid communication with the fluid conducting structure of the tool. The workstring is coupled to the shifting tool such that forces applied to the workstring are transmitted to the shifting tool to actuate displacement of the flow control member 114 relative to the one or more ports 118. In some embodiments, for example, a suitable shifting tool is the Shift-Frac-Close™ tool available from NCS Multistage Inc. In some embodiments, for example, a suitable shifting tool is described in U.S. Patent Publication No. 20160251939A1. In this respect, in some embodiments, for example, the flow control member 114 is configured for gripping engagement by a shifting tool for translation with the shifting tool. In some embodiments, for example, the translation with the shifting tool is effected while the shifting tool is being moved within the wellbore 102 in response to an applied fluid pressure differential.

In some embodiments, for example, for each one of the flow communication stations 1115, 2115, and 3115, displacement of the flow control member 114, relative to the one or more ports 118, for effecting opening and closing of the one or more ports 118, for effecting stimulation of the hydrocarbon material-containing reservoir, is effected by a shifting tool, and re-opening of the one or more ports 118, for establishing flow communication with the reservoir such that hydrocarbon material is conducted to the surface, via the wellbore 102, and thereby produced via the wellbore 102, is effected by a displacement of the flow control member 114, relative to the one or more ports 118, that is actuated in response to the expiry of a countdown timer. In some embodiments, for example, the countdown timer is started in response to the sensing of an actuating condition.

Figure 18:
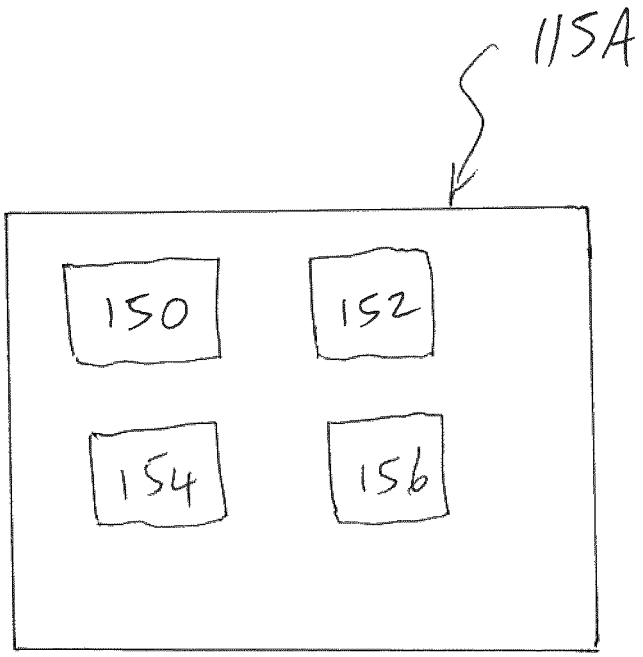
FIG. 18 is a schematic illustration of some of the hardware components of an embodiment of a flow control apparatus.

In this respect, and referring to FIG. 18, in some embodiments, for example, the flow control apparatus 115A includes a timer 152 coupled to the sensor 150 and configured to start a countdown timer in response to the sensing of an actuating condition by the sensor 150. The flow control apparatus 115A further includes a controller 154 and an actuator 156, wherein the controller 154, the actuator 156, the timer 152, and the sensor 150 are co-operatively configured such that, in response to the sensing of an actuating condition, the timer 152 starts a countdown timer, and, in response to the expiry of the countdown timer, the controller 154 effects displacement of the flow control member 114, relative to the one or more ports 118, via the actuator 156, such that the flow control member 114 is displaced, relative to the one or more ports 118. In some embodiments, for example, the displacement of the flow control member effects opening of the one or more ports 118. In some embodiments, for example, the displacement of the flow control member effect closing of the one or more ports 118. In some embodiments, for example, the actuator includes any one of the actuators described above. In this respect, in some embodiments, for example, the displacement of the flow control member, relative to the one or more ports 118, for effecting the opening of the one or more ports 118, is effected using any one of the actuation systems above-described and illustrated in FIGS. 2 to 8.

In some embodiments, for example, the actuating condition includes a characteristic within the wellbore that is produced in response to a movement of the flow control member relative to the one or more ports 118. In this respect, in some embodiments, for example, the sensed movement includes movement that effects opening of the one or more ports 118. In some embodiments, for example, the sensed movement includes movement that effects closing of the one or more ports 118. In some embodiments, for example, the sensed movement includes movement that effects, in sequence, opening and closing of the one or more ports 118. In some embodiments, for example, the sensed movement includes movement that effects, in sequence, closing and opening of the one or more ports 118.

In some embodiments, for example, a magnet is coupled to the flow control member 114 such that the magnet is translatable with the flow control member 114, and the sensor 150 includes a Hall effect sensor. In this respect, the flow control member 114 and the sensor 150 are co-operatively configured such that a movement of the flow control member is sensed by the Hall effect sensor.

In some embodiments, for example, the sensor 150 includes an accelerometer for sensing the movement of the flow control member 114.

Figure 19:
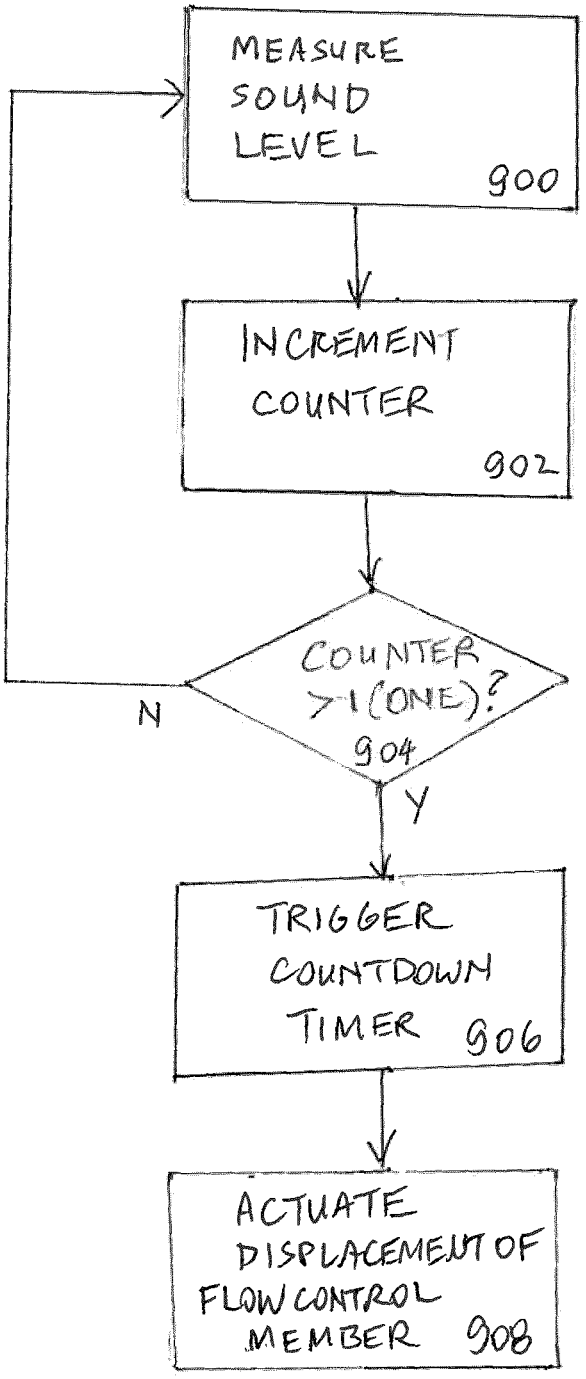
FIG. 19 is a flow chart depicting a process of opening a flow control apparatus of FIG. 18.

In some embodiments, for example, for each one of the flow communication stations, independently, associated with the opening and closing of the one or more ports 118 by the flow control member 114 is the sound generated in response to the collision of the flow control member 114 with a stop (e.g. shoulder) disposed within the flow control apparatus 115A while a force is being applied to the flow control member 114 (such as, for example, by a shifting tool) for effecting the displacement of the flow control member 114, relative to the one or more ports 118. In the case of the opening of the one or more ports 118, this displacement is the displacement of the flow control member 114 from the closed position to the open position. In the case of the opening of the one or more ports 118, this displacement is the displacement of the flow control member 114 from the open position to the closed position. In this respect, in some of these embodiments, for example, the sensor 150 includes a transceiver for sensing these sounds associated with the movement of the flow control member 114. In this respect, and referring to FIG. 19, in some embodiments, for example, at block 900, the controller 500 periodically polls sensor 150 for measurements of sound level within the wellbore 102 (e.g. with a transceiver). Sound level above a particular threshold may be associated with the opening or closing of the one or more ports 118. If the sound level exceeds a predetermined threshold, the controller 154 increments a counter at block 902 and proceeds to block 904. At block 904, the controller 154 checks if the counter is equal to the number two (2). If so, at block 906, the controller 154 triggers the countdown timer of the timer 152. When the counter is equal to the number (2), this is representative of two collisions between the flow control member 114 and stops of the flow control apparatus 115A, and the fact that there have been the two collisions is representative of the flow control member 114 having been displaced to open the one or more ports 118 to provide for the flow communication to enable the injection of treatment material into the reservoir, and then to close the one or more ports 118 after the injection, with effect the simulation of the reservoir zone associated with the flow communication station is completed. At block 908, upon the expiration of the countdown timer, the flow control member 114 is actuated into displacement, relative to the one or more ports 118, from the closed position to the open position, and thereby effecting opening of the one or more ports 118 to enable production of hydrocarbon material from the reservoir via the one or more ports.

A similar protocol would be used for those embodiments whose sensor 150 includes an accelerometer, with exception that the counter is incremented in response to sensed acceleration (or deceleration) exceeding a particular threshold.

If Hall effect sensors are used to sense the above-described opening and the closing of the one or more ports 118 during the stimulation operation, a first Hall effect sensor (secured for example to flow control member 114) would be used to sense the opening of the one or more ports 118 by the flow control member 114, by sensing of a first magnet (secured for example to the housing 120), becoming disposed in sufficient proximity of the first Hall effect sensor while the first Hall effect sensor translates with the flow control member 114 to the open position, and a second Hall effect sensor (also secured for example to flow control member 114) would be used to sense the closing of the one or more ports 118 by the flow control member 114, by sensing of a second magnet (secured for example to the housing 120) becoming disposed in sufficient proximity of the second Hall effect sensor while the second Hall effect sensor translates with the flow control member 114 to the open position. In some examples, the locations of the Hall effect sensors and the magnets could be reversed.

In some embodiments, for example, stimulation of the reservoir is effected, and the stimulation of the reservoir includes, for each one of the flow communication stations 1115, 2115, and 3115, independently, displacing the flow control member 114, relative to the one or more ports 118, with a shifting tool, from the closed position to the open position, such that the one or more ports 118 become disposed in the open condition (i.e. opening of the one or more ports 118 is effected), and, while the one or more ports 118 of the flow communication station (1115, 2115, or 3115) are opened, injecting treatment material into the reservoir via the opened one or more ports 118 for effecting stimulation of the reservoir via the flow communication station (e.g. 1115, 2115, or 3115), and after the injecting of treatment material, displacing the flow control member 114, relative to the one or more ports 118, with a shifting tool, from the open position to the closed position, such that the one or more ports 118 become disposed in a closed condition (i.e. closing of the one or more ports 118 is effected), such that the stimulation, via the flow communication station (1115, 2115, or 3115), is completed.

In some embodiments, for example, subsets of the plurality of flow communication stations (e.g. 1115, 2115, or 3115) are stimulated in sequence, wherein each one of the subsets, independently, is at least one flow communication station. In this respect, in some embodiments, for example, while a stimulated one of the subsets is being stimulated, the flow control members of the other ones of the subsets are disposed in the closed position such that treatment fluid being injected into the wellbore 102 is directed into a zone of the reservoir via the stimulated one of the subsets, while bypassing, or substantially bypassing, zones of the reservoir that are aligned with the flow communication stations of the other ones of the subsets, with effect that there is an absence of stimulation of such zones via the flow communication stations of the other ones of the subsets. Also, in this respect, stimulation of another one of the subsets is not commenced until the simulation of the stimulated one of the subsets is completed. In some of these embodiments, for example, each one of the plurality of flow communication stations, independently, is stimulated in sequence.

After completion of the stimulation via the flow communication stations 1115, 2115, and 3115, production of the stimulated reservoir, via the flow communication stations 1115, 2115, and 3115, is effected, and the production of the stimulated reservoir includes, for each one of the flow communication stations 1115, 2115, and 3115, independently, after the displacement of the flow control member 114, relative to the one or more ports 118, for effecting closing of the one or more ports 118 following the stimulation through the flow communication station (1115, 2115, or 3115), starting a countdown timer, and, in response to the expiry of the countdown timer, displacing the flow control member 114, relative to the one or more ports 118, with an actuator (such as, for example, any one of the actuators described above), such that the flow control member 114 is displaced from the closed position to the open position, thereby effecting opening of the one or more ports 118. The starting and expiration of the countdown timers of all of the flow communication stations 1115, 2115, and 3115 are co-ordinated such that the opening of the one or more ports 118 of any one of the flow communication stations, in response to the expiry of the respective countdown timer, is only effectible after the stimulation via all of the flow communication stations has been completed. In some embodiments, for example, this displacement of the flow control member 114, relative to the one or more ports 118, for effecting the opening of the one or more ports 118, and thereby enabling the production of the hydrocarbon material from the reservoir, is effected using any one of the actuation systems above-described and illustrated in FIGS. 2 to 8. As described above, in some embodiments, for example, the countdown timer is started in response to the sensing of the actuating condition. In some embodiments, for example, the actuating condition is the completion of the stimulation via the flow communication station, as represented by the sequential opening and closing of the one or more ports 118 by the flow control member 114, and such actuating condition could be sensed by Hall effect sensors, an accelerometer, or a transceiver, or any combination thereof.

After the opening of the one or more ports 118, hydrocarbon material is conducted from the stimulated reservoir to the wellbore 102 via the one or more ports 118, and then to the surface via the wellbore 102. In some embodiments, for example the expiration of the countdown timers of all of the flow communication stations is co-ordinated such that the expiration is simultaneous, or substantially simultaneous, with effect that production is commenced simultaneously or substantially simultaneously. In some embodiments, for example, the expiration of the countdown timers of all of the flow communication stations is co-ordinated such that, for each one of a plurality of flow communication subsets (each one of the subsets, independently, is at least one flow communication station), the expiration is staggered. In some embodiments, for example, each one of the plurality of flow communication stations, independently, the expiration of the countdown timer is staggered.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A method of remotely operating a downhole flow control device in a wellbore string of a hydraulic fracturing system to effect an exchange of a fluid between the wellbore string and a subterranean formation, comprising:

encoding a control message as a sequence of digits for actuating said flow control device;

transmitting said control message by relieving pressure from a fluid in said wellbore string in a sequence of stages to drop fluid pressure in the wellbore string cumulatively from an initial static fluid pressure to a lower fluid pressure at a completion of the stages, wherein said relieving pressure comprises modulating a rate of change of fluid pressure over the sequence of stages to encode the sequence of digits.

2. The method of claim 1 wherein the sequence of digits includes address information for the flow control device.

3. The method of claim 1 wherein the sequence of digits includes a synchronization and/or training sequence known to the flow control device.

4. The method of claim 1 wherein encoding the control message includes applying error correction coding.

5. The method of claim 1 wherein each of the digits is a binary digit, with a first rate of change of the fluid pressure representing a first value and a second rate of change of the fluid pressure representing a second value.

6. The method of claim 5 wherein modulating the first rate of change comprises relieving pressure from the fluid by opening a valve and subsequently closing the valve during a stage to release fluid from said wellbore and modulating the second rate of change comprises maintaining the valve in a closed position during a stage.

7. The method of claim 1 wherein each of the digits has more than two possible values, and each value is represented as a different rate of change of fluid pressure in a stage.

8. The method of claim 1 wherein the sequence of digits encodes the control message to actuate said flow control device to open.

9. A control system for remotely operating a downhole flow control device in a wellbore string of a hydraulic fracturing system to effect an exchange of a fluid between the wellbore string and a subterranean formation, comprising:

an actuator for opening and closing a valve at a wellhead of the wellbore string to selectively release pressure from the fluid in the wellbore string; and a wellhead controller configured to cause the actuator to open and close the valve to modulate a multi-digit control message onto the fluid for the flow control device by selectively releasing pressure from the fluid in stages to drop fluid pressure in the wellbore string cumulatively from an initial static fluid pressure to a lower fluid pressure at a completion of the stages, wherein different rates of dropping pressure change within stages are used to indicate different values that comprise the multi-digit control message, and wherein each stage corresponds to a digit of the control message.

10. The control system of claim 9 wherein the control message is encoded as binary digits, the wellhead controller being configured to cause the actuator to open and close the valve during a stage to represent a first binary digit value and to cause the actuator to keep the valve closed during a stage to represent a second binary digit value.

11. A method of operating a downhole flow control apparatus in a wellbore string of a hydraulic fracturing system to effect an exchange of a fluid between the wellbore string and a subterranean formation, the flow control apparatus comprising a housing defining a fluid passage, a flow control device sealing an outlet of said fluid passage, an actuator for manipulating said flow control device to an open condition to permit fluid flow through said outlet, a controller for selectively activating said actuator, and a pressure sensor for sensing pressure in the fluid passage, the method comprising:

periodically sampling a pressure in the fluid passage using the pressure sensor;

analyzing the samples, by the controller, to determine if a control message has been pressure modulated onto a fluid in the fluid passage using varying rates of pressure drops throughout a series of successive pressure drops from an initial static fluid pressure to a lower fluid pressure, and if so, decoding the control message based on the samples and determining if the decoded control message includes an instruction for the controller to activate said actuator; and activating the actuator, if the control message includes an instruction for the controller to activate said actuator, to manipulate said flow control device to the open condition.

12. The method of claim 11 wherein analyzing the samples to determine if the control message has been pressure modulated onto a fluid comprises determining if the samples include a pattern that corresponds to a predefined preamble.

13. The method of claim 11 wherein determining if the decoded control message includes an instruction for the controller to activate said actuator comprises determining if the decoded control message includes address information that matches an address assigned to the controller.

14. The method of claim 11 comprising low pass filtering the samples to remove noise that exceeds a cut-off frequency, and storing the filtered samples in a memory of the controller, wherein analyzing the samples comprises analyzing the filtered, stored samples.

15. The method of claim 14 wherein the cut-off frequency is selected to remove noise resulting from a fluid hammer effect caused by opening and shutting of a valve at a wellhead of the wellbore string.

16. The method of claim 11 wherein the control message is pressure modulated as a set of successive symbols onto the fluid, the symbols each having a defined symbol duration with different symbol values being encoded as a different rate of fluid pressure release over the symbol duration, and analyzing the samples and decoding the control message comprises determining a pressure drop in the fluid based on the samples over successive symbol durations.

17. The method of claim 16 wherein decoding the control message comprises predicting a value of each of the symbols of the control message based on comparing the pressure drop over the symbol duration with a threshold, wherein the value is determined to be a first value if the pressure drop is above the threshold and a second value if the pressure drop is below the threshold.

18. The method of claim 17 comprising determining the threshold based on averaging information that is included in the samples that correspond to a plurality of the symbols of the control message.

19. The method claim 11 comprising, prior to installation of flow control apparatus down a wellbore, programming the controller with information about the control message by: using an optical transducer to provide the information to an optical interface of the flow control apparatus and/or using an acoustic transducer to provide the information to an acoustic interface of the flow control apparatus.

20. A downhole flow control apparatus for use in a wellbore string of a hydraulic fracturing system to effect an exchange of a fluid between the wellbore string and a subterranean formation, comprising:

a housing defining a fluid passage;

a flow control device sealing an outlet of said fluid passage;

an actuator for manipulating said flow control device to an open condition to permit fluid flow through said outlet;

a pressure sensor for sensing pressure in the fluid passage;

a controller configured to:

receive periodic pressure samples for fluid in the fluid passage from the pressure sensor;

analyze the pressure samples to determine if a control message has been pressure modulated onto a fluid in the fluid passage by varying rates of pressure drops within a set of pressure drops from an initial static fluid pressure to a lower fluid pressure, and if so, decode the control message based on the pressure samples and determine if the decoded control message includes an instruction for the controller to activate said actuator; and activate the actuator, if the control message includes an instruction for the controller to activate said actuator, to manipulate said flow control device to the open condition.

* * * * *